US006789869B2

(12) United States Patent
Takeishi

(10) Patent No.: US 6,789,869 B2
(45) Date of Patent: Sep. 14, 2004

(54) PRINTER CONTROL APPARATUS AND PRINTER CONTROL METHOD

(75) Inventor: Tetsuji Takeishi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 355 days.

(21) Appl. No.: 10/083,664

(22) Filed: Feb. 27, 2002

(65) Prior Publication Data

US 2002/0163568 A1 Nov. 7, 2002

(30) Foreign Application Priority Data

Feb. 28, 2001 (JP) ..... 2001-055108
Feb. 25, 2002 (JP) ..... 2002-047616

(51) Int. Cl.[7] ..... B41J 29/38
(52) U.S. Cl. ..... 347/16
(58) Field of Search ..... 346/16, 5, 9, 14, 346/10; 399/18, 37, 38–65, 9–14, 16

(56) References Cited

U.S. PATENT DOCUMENTS 5,321,486 A * 6/1994 Nanbu et al. ..... 399/14

* cited by examiner

*Primary Examiner*—Raquel Yvette Gordon
(74) *Attorney, Agent, or Firm*—Sughrue Mion, PLLC

(57) ABSTRACT

The present invention relates to printer-control apparatus and method that achieve PF measurements at the time of printer power-on and also other occasions for precise control to a paper-feed motor for driving a paper-feed mechanism of a printer to be used in variety of environments even at a small paper-feeding amount in one paper-feeding action. The present invention also relates to a storage medium storing a computer program for executing the printer-control method. The printer-control apparatus and method according to the present invention generate and execute an operation for PF-measurements to measure a motor current in accordance with load on paper feeding while a paper-feed motor is running at a constant-speed driving in accordance with detection of several statuses in addition to printer power-on.

26 Claims, 19 Drawing Sheets

PRINTER CONTROL APPARATUS AND PRINTER CONTROL METHOD

BACKGROUND OF THE INVENTION

1. Field of the Invention

The present invention relates to printer-control apparatus and method. Particularly, this invention relates to printer-control apparatus and method that achieve PF (paper-feed) measurements to measure motor currents in accordance with the load on a motor at a constant-speed driving operation and calculate the average of the motor currents at several occasions in addition to at the time of printer power-on, for precise paper-feed control even at a small paper-feeding amount in one paper-feeding action. The present invention also relates to a storage medium storing a program for executing the printer-control method.

2. Related Background Art

PF (paper-feed) measurements are known for printer-control apparatus and methods in which motor currents are measured in accordance with the load on a motor at a constant-speed driving operation and the average of the motor currents is calculated at the time of printer power-on, for precise paper-feed control even at a small paper-feeding amount in one paper-feeding action.

For regular-type printers, an acceleration control under an open-loop control is performed on starting of motor for paper feeding and thereafter a constant-speed control is performed under a PID control switched from the open-loop control when the motor speed approaches a speed within the constant-speed control range.

Under the PID control, the integrals of motor currents I are accumulated and the magnitude of load on a motor is always measured for motor-current control in accordance with the load magnitude with which the motor currents I have a proportional relation. Variation in motor current I due to disturbances, etc., under the PID control will not affect the precise control because of motor-current adjustments using accumulated integrals of motor currents I.

On the contrary, under the open-loop control, accumulation of the integrals of motor currents I will not be performed, and hence motor-current adjustments cannot be applied in case of variation in motor current I due to disturbances, etc. Motor-current errors will thus often occur during the open-loop control just after the motor start-up, causing imprecise control.

The open-loop control is switched to the PID control before the completion of paper-feed operation for a large paper-feeding amount in one paper-feeding action. A precise paper-positioning is thus relatively easily achieved with motor-current adjustments using accumulated integrals of motor currents I in case of errors in motor current.

Contrary to this, the open-loop control almost dominates the paper-feed operation for a small paper-feeding amount in one paper-feeding action. A precise paper-positioning will not be achieved due to short time and distance for this paper-feed operation and the motor-current adjustments using accumulated integrals of motor currents I being impossible in case of errors in motor current.

Therefore, the known PF measurements are performed whenever a printer is turned on such that motor currents are measured beforehand in accordance with the load on a motor at a constant-speed PF-motor driving operation and the average of the motor currents is calculated using the integrals of motor currents for indirect measurements of the load on paper feeding.

In detail, the known PF measurements are performed such that motor currents are measured for a paper-feeding operation carried out when a printer is turned on and the integrals of motor currents are accumulated in calculation of average motor current for indirect measurements of the load on a paper-feeding mechanism. Measurements of the load on a paper-feeding mechanism may not always require printing papers set therein. The calculated average motor current is stored in a memory installed in a printer. Pre-stored in the memory is an offset value of a motor current converted from the load on the paper-feeding mechanism that is a printing paper set therein. The calculated average motor current and the offset value may be stored in different memories.

The average motor current obtained through the PF measurements will be applied to a subsequent paper-feed operation at a small paper-feed amount in one paper-feeding action, with no PID control. Average motor currents obtained through the PF measurements carried out with a printing paper set in the paper-feeding mechanism are available with no offset values. On the contrary, average motor currents obtained through the PF measurements carried out with no printing papers set in the paper-feed mechanism require offset values. Accordingly, a precise paper-positioning with an accurate paper-feeding control is achieved even at a small paper-feeding amount in one paper-feeding action.

The known PF measurements will be performed whenever a printer is turned on due to variation in load on a paper-feeding mechanism caused by several factors. For example, the load on a paper-feeding mechanism of each printer when shipped from factories will relatively be large but small when the paper-feeding mechanism works smoothly after several uses. In addition, a low environmental temperature will cause a large load on driving whereas a high environmental temperature will cause a small load on driving. Other factors for variation in load on driving are, for example, the amount of lubricant and its condition used for a paper-feeding mechanism and abrasion conditions for rotary shafts incorporated in the mechanism. The maximum degree of variation in load on driving could reach two times the minimum degree.

Therefore, the known PF measurements are performed whenever a printer is turned on, for a precise paper-feed control using the most suitable average motor current calculated per measurement.

The known PF measurements, however, have the following drawbacks due to the fact that the measurements are carried out only when a printer is turned on.

Printers have been used widely and many of them are installed in offices and convenience stores, etc., as network printers that operate for 24 hours or a long period of time.

Application of the known PF measurements available only at the time of power on to these printers thus cause long use of an average motor-current value once calculated to paper-feed control.

The load on a paper-feeding mechanism and the corresponding motor current will, however, vary due to several factors as discussed. This variation causes a large difference between an average motor current to be applied to a paper-feeding mechanism and a motor current in accordance with an actual load on driving, thus lowering accuracy of paper-feed control.

SUMMARY OF THE INVENTION

A purpose of the present invention is to provide printer-control apparatus and method that achieve PF measurements at the time of printer power-on and also other occasions for precise control to a paper-feed motor for driving a paper-feeding mechanism of a printer to be used in variety of environments even at a small paper-feeding amount in one paper-feeding action.

According to the printer-control apparatus of the present invention, there is provided with a printer-control apparatus comprising a PF-measurement generator/executor for generating and executing an operation for PF-measurements to measure a motor current in accordance with load on paper feeding while a paper-feed motor is running at a constant-speed driving in accordance with detection of specific statuses in addition to printer power-on.

According to the printer-control method of the present invention, there is provided with a printer-control method comprising the step of generating and executing an operation for PF-measurements to measure a motor current in accordance with load on paper feeding while a paper-feed motor is running at a constant-speed driving in accordance with detection of specific statuses in addition to printer power-on.

In the above configuration of the printer-control apparatus and method of the present invention, the PF-measurements may include calculation of an average motor-current value for the paper-feed motor.

The present invention achieves PF measurements at the time of printer power-on and also other occasions with measurements and calculation of average motor currents in accordance with the motor load at a constant-speed driving, with average motor-current updating. These feature offer a precise control of a paper-feed motor for driving a paper-feeding mechanism even at a small paper-feeding amount in one paper-feeding action for printers to be used in several environments, for example, use for 24 hours or a long period of time.

The detection of statuses may include detection of ink-cartridge replacements or detection of the replacements of a rolled printing paper.

According to the first configuration of the printer-control apparatus of the present invention, there is provided with a printer-control apparatus comprising:

- an ink-cartridge replacement detector to detect replacements of an ink-cartridge;
- a release detector, responsive to the detection of the ink-cartridge replacements, to determine whether a paper-feeding mechanism is in a nipping status for paper-feeding for printing papers with thickness within a specific range or in a release status for paper-feeding for printing papers with thickness out of the specific range;
- a printing-paper detector, responsive to the detection of the ink-cartridge replacements, to determine whether any printing paper has been set in the paper-feeding mechanism;
- a PF-measurement generator/executor for generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping status, and the determination that no printing paper has been set in the paper-feeding mechanism; and
- a memory to store accumulated integral values of the motor current calculated through the PF measurements and the average motor current also calculated through the PF measurements for updating.

According to the second configuration of the printer-control apparatus of the present invention, there is provided with a printer-control apparatus comprising:

- a roll-paper replacement detector to detect replacements of a rolled printing paper;
- a release detector, responsive to the detection of the roll-paper replacements, to determine whether a paper-feeding mechanism is in a nipping status for paper-feeding for printing papers with thickness within a specific range or in a release status for paper-feeding for printing papers with thickness out of the specific range;
- a printing-paper detector, responsive to the detection of the roll-paper replacements, to determine whether any printing paper has been set in the paper-feeding mechanism;
- a PF-measurement generator/executor for generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination that no printing paper has been set in the paper-feeding mechanism; and
- a memory to store accumulated integral values of the motor current calculated through the PF measurements and the average motor current also calculated through the PF measurements for updating.

According to the third configuration of the printer-control apparatus of the present invention, there is provided with a printer-control apparatus comprising:

- a power-on detector to detect printer power-on;
- an ink-cartridge replacement detector to detect replacements of an ink-cartridge;
- a roll-paper replacement detector to detect replacements of a roll printing paper;
- a release detector, responsive to the detection of power on, ink-cartridge replacement or roll-paper replacements, to determine whether a paper-feeding mechanism is in a nipping status for paper-feeding for printing papers with thickness within a specific range or in a release status for paper-feeding for printing papers with thickness out of the specific range;
- a printing-paper detector, responsive to the detection of power on, ink-cartridge replacement or roll-paper replacements, to determine whether any printing paper has been set in the paper-feeding mechanism;
- a PF-measurement generator/executor for generating and executing an operation for PF-measurements to measure a motor current in accordance with load on paper feeding while a paper-feed motor is running at a constant-speed driving and calculate an average motor current in accordance with the detection of printer power on, ink-cartridge replacement or roll-paper replacements, and the detection of the nipping status and the determination that no printing paper has been set in the paper-feeding mechanism; and
- a memory to store accumulated integral values of the motor current calculated through the PF measurements and the average motor current also calculated through the PF measurements for updating.

According to the fourth configuration of the printer-control apparatus of the present invention, there is provided with a printer-control apparatus comprising:

an ink-cartridge replacement detector to detect replacements of an ink-cartridge;

a release detector, responsive to the detection of the ink-cartridge replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of the ink-cartridge replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping status, and the determination as to whether any printing paper has been set in the paper-feeding mechanism; and a memory to store accumulated integral values of the motor current calculated through the PF measurements and the average motor current also calculated through the PF measurements for updating.

According to the fifth configuration of the printer-control apparatus of the present invention, there is provided with a printer-control apparatus comprising:

a roll-paper replacement detector to detect replacements of a roll printing paper;

a release detector, responsive to the detection of the roll-paper replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of the roll-paper replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination as to whether any printing paper has been set in the paper-feeding mechanism; and a memory to store accumulated integral values of the motor current calculated through the PF measurements and the average motor current also calculated through the PF measurements for updating.

According to the sixth configuration of the printer-control apparatus of the present invention, there is provided with a printer-control apparatus comprising:

a power-on detector to detect printer power-on;

an ink-cartridge replacement detector to detect replacements of an ink-cartridge;

a roll-paper replacement detector to detect replacements of a roll printing paper;

a release detector, responsive to the detection of power on, ink-cartridge replacement or roll-paper replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of power on, ink-cartridge replacement or roll-paper replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of power on, ink-cartridge replacement or roll-paper replacements, and the detection of the nipping status and the determination as to whether any printing paper has been set in the paper-feeding mechanism; and a memory to store accumulated integral values of the motor current calculated through the PF measurements and the average motor current also calculated through the PF measurements for updating.

According to the first configuration of the printer-control method of the present invention, there is provided with a printer-control method comprising the steps of:

detecting replacements of an ink-cartridge;

in response to the detection of the ink-cartridge replacements, determining whether a paper-feeding mechanism is in a nipping status for paper-feeding for printing papers with thickness within a specific range or in a release status for paper-feeding for printing papers with thickness out of the specific range;

in response to the detection of the ink-cartridge replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping status, and the determination that no printing paper has been set in the paper-feeding mechanism; and storing the average motor current calculated through the PF measurements for updating.

According to the second configuration of the printer-control method of the present invention, there is provided with a printer-control method comprising the steps of:

detecting replacements of a roll printing paper;

in response to the detection of the roll-paper replacements, determining whether a paper-feeding mechanism is in a nipping status for paper-feeding for printing papers with thickness within a specific range or in a release status for paper-feeding for printing papers with thickness out of the specific range;

in response to the detection of the roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination that no printing paper has been set in the paper-feeding mechanism; and storing the average motor current calculated through the PF measurements for updating.

According to the third configuration of the printer-control method of the present invention, there is provided with a printer-control method comprising the steps of:

detecting printer power-on, replacements of an ink-cartridge or replacements of a roll printing paper;

in response to the detection of printer power-on, ink-cartridge replacement or roll-paper replacements, determining whether a paper-feeding mechanism is in a nipping status for paper-feeding for printing papers with thickness within a specific range or in a release status for paper-feeding for printing papers with thickness out of the specific range;

in response to the detection of printer power-on, ink-cartridge replacement or roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of printer power-on, ink-cartridge replacement or roll-paper replacements, and the detection of the nipping status and the determination that no printing paper has been set in the paper-feeding mechanism; and storing the average motor current calculated through the PF measurements for updating.

According to the fourth configuration of the printer-control method of the present invention, there is provided with a printer-control method comprising the steps of:

detecting replacements of an ink-cartridge;

in response to the detection of the ink-cartridge replacements, determining whether a paper-feeding mechanism is in a nipping status for paper-feeding for printing papers with thickness within a specific range or in a release status for paper-feeding for printing papers with thickness out of the specific range;

in response to the detection of the ink-cartridge replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping stattus, and the determination as to whether any printing paper has been set in the paper-feeding mechanism; and storing the average motor current calculated through the PF measurements for updating.

According to the fifth configuration of the printer-control method of the present invention, there is provided with a printer-control method comprising the steps of:

detecting replacements of a roll printing paper;

in response to the detection of the roll-paper replacements, determining whether a paper-feeding mechanism is in a nipping status for paper-feeding for printing papers with thickness within a specific range or in a release status for paper-feeding for printing papers with thickness out of the specific range;

in response to the detection of the roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination as to whether any printing paper has been set in the paper-feeding mechanism; and storing the average motor current calculated through the PF measurements for updating.

According to the sixth configuration of the printer-control method of the present invention, there is provided with a printer-control method comprising the steps of:

detecting printer power-on, replacements of an ink-cartridge or replacements of a roll printing paper;

in response to the detection of printer power-on, ink-cartridge replacement or roll-paper replacements, determining whether a paper-feeding mechanism is in a nipping status for paper-feeding for printing papers with thickness within a specific range or in a release status for paper-feeding for printing papers with thickness out of the specific range;

in response to the detection of printer power-on, ink-cartridge replacement or roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of printer power-on, ink-cartridge replacement or roll-paper replacements, and the detection of the nipping status and the determination as to whether any printing paper has been set in the paper-feeding mechanism; and storing the average motor current calculated through the PF measurements for updating.

A storage medium according to the present invention stores a computer program for executing any of the printer-control methods of the present invention on a computer system.

DETAILED DESCRIPTION OF PREFERRED EMBODIMENTS

Disclosed first are an overview of an inkjet printer and a method of controlling the inkjet printer, the main target of the printer-control apparatus and method according to the present invention to be applied.

Figure 1:
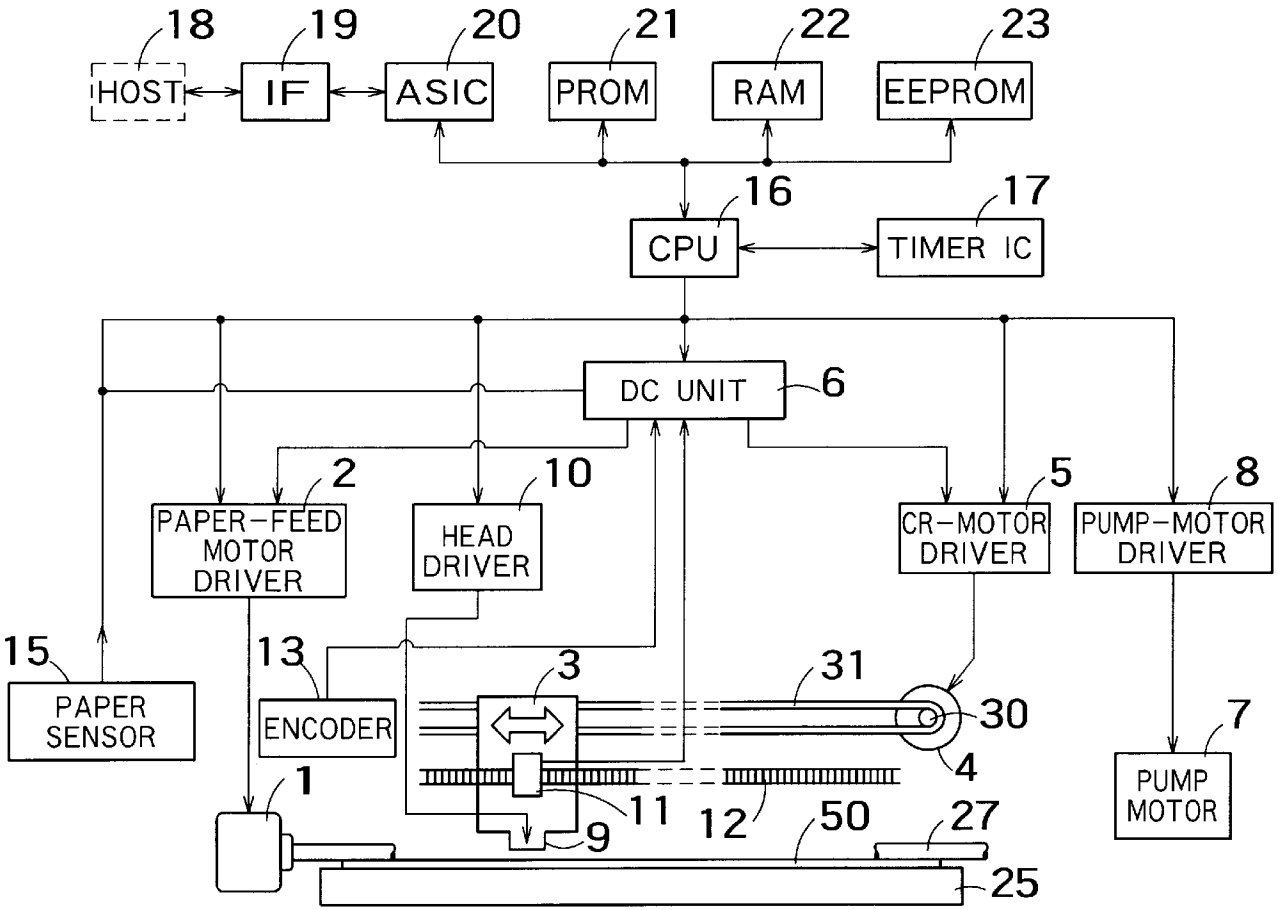
FIG. 1 is a block diagram showing an overview of an inkjet printer.

FIG. 1 is a block diagram showing an overview of an inkjet printer;

The inkjet printer is equipped with the following components: a paper-feed motor (termed as PF motor occasionally) 1 for paper feeding; a paper-feed motor driver 2 for driving the paper-feed motor 1; a carriage 3 having a head 9 for discharging ink onto a printing paper 50, the carriage 3 being driven in directions horizontal to the printing paper 50 and orthogonal to a paper-feed direction; a carriage motor (termed as CR motor occasionally) 4 for driving the carriage 3; a CR-motor driver 5 for driving the carriage motor 4; a DC unit 6 for supplying a direct-current command value to the CR-motor driver 5; a pump motor 7 for controlling suction of ink to protect the head 9 from being plugged up with dried ink; a pump-motor driver 8 for driving the pump motor 7; a head driver 10 for driving the head 9; a linear encoder 11 fixed on the carriage 3; a code disk 12 having slits formed per a specific interval, incorporated in the linear encoder 11; a rotary encoder 13 to be used for the PF motor 1; a paper sensor 15 for detecting the end of a printing paper under printing process; a CPU 16 for overall control to the printer; a timer IC 17 for periodically generating interrupting signals to the CPU 16; an interface (termed as IF occasionally) 19 for data communications with a host computer 18; an ASIC 20 for controlling printing resolution, driving waveforms, and so on, based on printing information sent from the host computer 18 via the IF 19; a PPROM, a RAM 22 and an EEPROM 23 to be used as working and/or program-storing areas for the ASIC 20 and CPU 16; a platen 25 for supporting the printing paper 50; a transfer roller 27 to be driven by the PF motor 1 for transferring the printing paper 50; a pulley 30 fixed on a rotary shaft of the CR motor 4; and a timing belt 31 to be driven by the pulley 30.

The DC unit 6 drives the paper-feed motor driver 2 and the CR-motor driver 5 based on a control command sent from the CPU 16 and the output of the encoders 11 and 13. The paper-feed motor 1 and the CR motor 4 are a DC motor.

Figure 2:
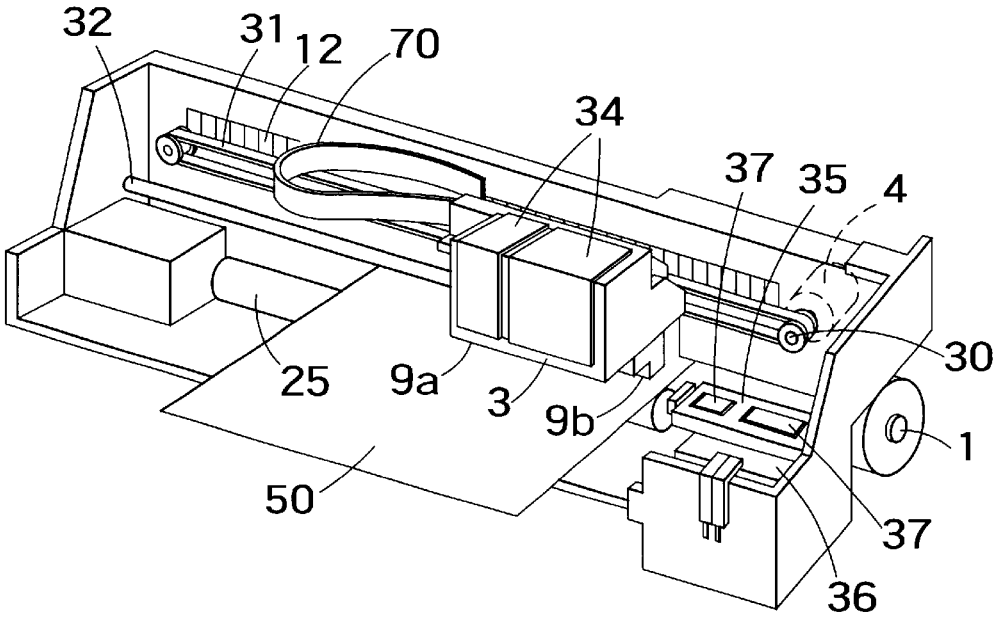
FIG. 2 is a perspective illustration of a carriage 3 and its peripherals in an inkjet printer.

FIG. 2 is a perspective illustration of the carriage 3 and its peripherals of the inkjet printer.

As illustrated in FIG. 2, the carriage 3 is driven as being moved along a guide 32 in the direction parallel to the platen 25 with the timing belt 31 running on the pulley 30 coupled to the carriage motor 4. Provided on the printing-paper facing surface of the carriage 3 is a print head 9 having nozzle alignment for spraying black ink and another nozzle alignment for spraying color ink. Each nozzle splays ink supplied by the ink cartridge 34 onto the printing paper to print characters and/or images thereon.

Incorporated into the inkjet printer within a non-printing area for the carriage 3 are capping unit 35 for capping the nozzles of the print head 9 while no printing process is performed and a pump unit 36 having the pump motor 7 shown in FIG. 1. The carriage 3 touches a lever (not shown) when it has moved from a printing area to the non-printing area. This action leads the capping unit 35 to move up to cap the head 9.

The pump unit 36 sucks ink from the nozzles of the head 9 by means of negative pressure in case of ink plugging occurred to the nozzles or forcefully spraying ink from the head 9 in the replacement of cartridge 34. This ink suction cleans up the nozzles from paper dust and any other dust attached the head 9 close to the nozzle openings and also discharges bubbles generated in the head with ink.

Figure 3:
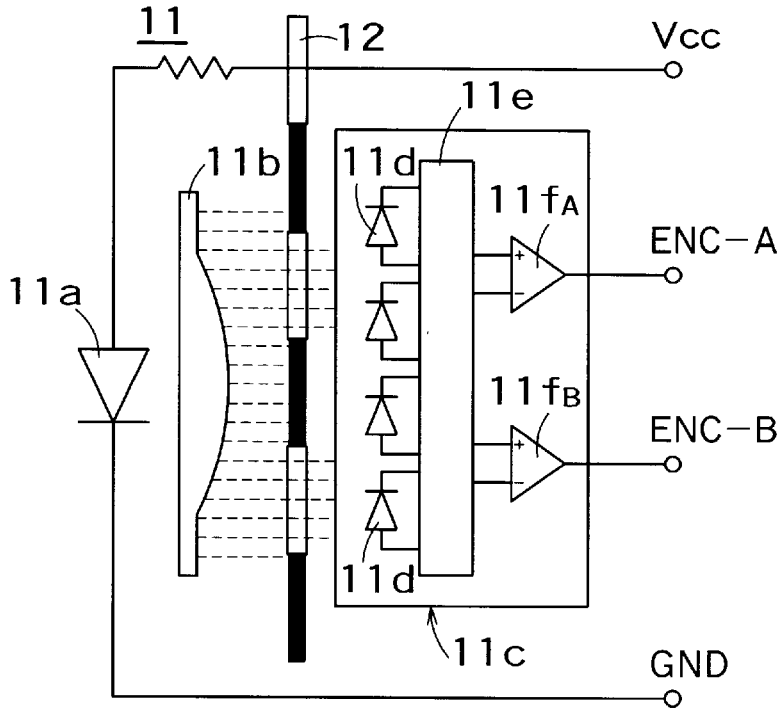
FIG. 3 is a schematic illustration of a linear encoder 11 attached to the carriage 3.

FIG. 3 is a schematic illustration of a linear encoder 11 attached to the carriage 3.

The encoder 11 shown in FIG. 3 is equipped with a light-emitting diode 11*a*, a collimator lens 11*b* and a detection processor 11*c*. The detection processor 11*c* has several (four) photodiodes 11*d*, a signal-processing circuit 11*e* and two comparators $\mathbf{11}f_A$ and $\mathbf{11}f_B$.

The light-emitting diode 11*a* emits light when a voltage Vcc is supplied across the diode 11*a* via resistor. The light is converged into parallel beams by the collimator lens 11*b*, which then pass through the code disk 12. Formed on the code disk 12 are several slits with a specific interval, such as 1/180 inches (1 inch=2.54 cm).

The parallel beams passing through the code disk 12 are incident to the photodiodes 11*d* passing through fixed slits (not shown) and converted into electrical signals. The electrical signals output from the four photodiodes 11*d* are processed by the signal-processing circuit 11*e*. The output signals of the circuit 11*e* are compared with a predetermined value by the comparators $\mathbf{11}f_A$ and $\mathbf{11}f_B$, respectively, thus outputting pulses as comparison results. Output pulses ENC-A and ENC-B of the comparators $\mathbf{11}f_A$ and $\mathbf{11}f_B$ are the outputs of the encoder 11.

Figure 4A:
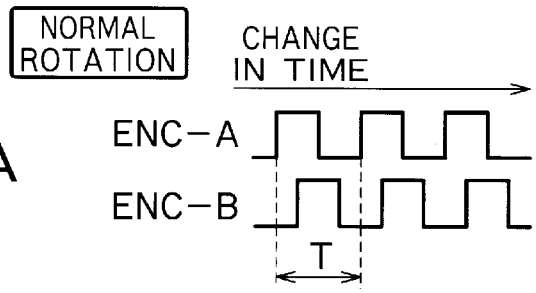
FIGS. 4A and 4B are timing charts indicating two signal waveforms output from the encoder 11 in CR-motor normal rotation and reverse rotation, respectively.
Figure 4B:
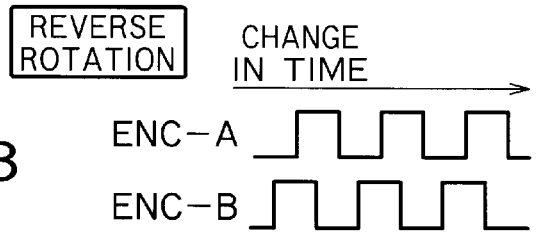

FIGS. 4A and 4B are timing charts indicating two signal waveforms output from the encoder 11 in CR-motor normal rotation and reverse rotation, respectively.

As illustrated in FIGS. 4A and 4B, the pulses ENC-A and ENC-B are shifted from each other by 90 degrees in phase in both CR-motor normal rotation and reverse rotation. In detail, the encoder 4 operates such that, as shown in FIG. 4A, the pulse ENC-A advances from the pulse ENC-B by 90 degrees in phase during the normal rotation of the CR-motor 4 whereas, as shown in FIG. 4B, the pulse ENC-A is delayed from the pulse ENC-B by 90 degrees in phase during the reverse rotation of the CR-motor 4. Each cycle T of the pulses corresponds to the slit interval (1/180 inches, etc.) on the code disk 12 and is equal to the time in which the carriage 3 traverses each slit interval.

The rotary encoder 13 used for the PF motor 1 has almost the same structure as the linear encoder 11 except that a code disk of the encoder 13 is a rotary disk rotating with the PF motor 1, to output two pulses ENC-A and ENC-B. Several slits formed on the code disk of the rotary encoder 13 have a slit interval of 1/180 inches. A printing paper is fed by 1/1440 inches while the PF motor 1 rotates by an angle corresponding to each slit interval.

Figure 5:
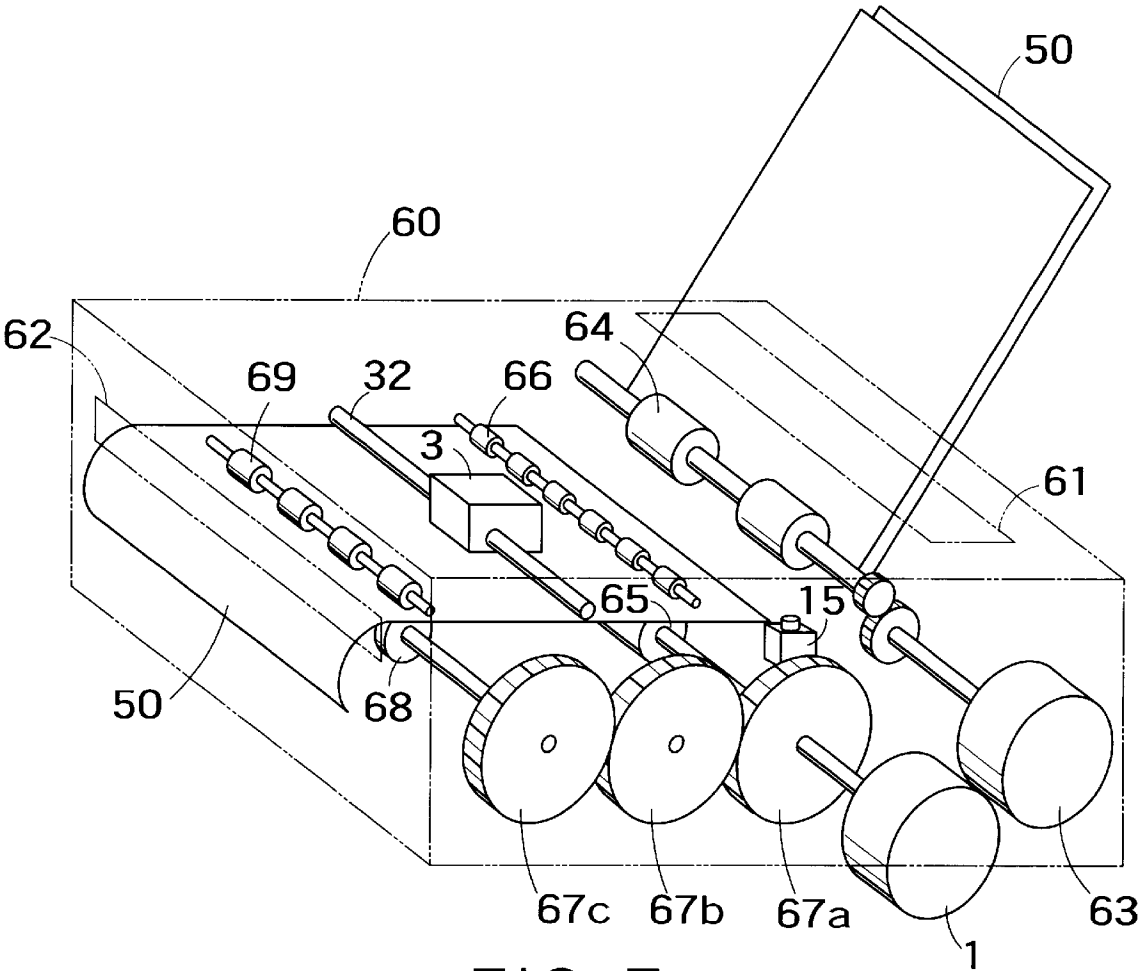
FIG. 5 is a perspective illustration of paper-supplying and detecting mechanisms.

FIG. 5 is a perspective illustration of paper-supplying and detecting mechanisms.

The location of the paper sensor 15 shown in FIG. 1 is explained with reference to FIG. 5. Each printing paper 50 inserted into a paper-supply opening 61 is fed into a printer 60 by a paper-supply roller 64 driven by a paper-supply motor 64. The front edge of the printing paper 50 fed into the printer 60 is detected by the paper sensor 15 such as an optical sensor. The paper feed advances with a paper-feed roller 65 driven by the PF motor 1 and a driven roller 66 for the printing paper 50 for which the front edge has been detected by the paper sensor 15.

A printing process is carried out with ink splayed on the printing paper 50 from the print head (not shown) attached to the carriage 3 moving along the carriage guide 32. When the printing paper 50 has been fed to a specific position, its rear edge is detected by the paper sensor 15 during printing. On completion of printing, the printing paper 50 is discharged to the outside through a paper-discharging opening 62 by a paper-discharging roller 68 driven by a gear 67*c* meshed with gears 67*a* and 67*b* driven by the PF motor 1 and also a driven roller 69. The rotary shaft of the paper-feed roller 65 is coupled to the rotary encoder 13.

Figure 6:
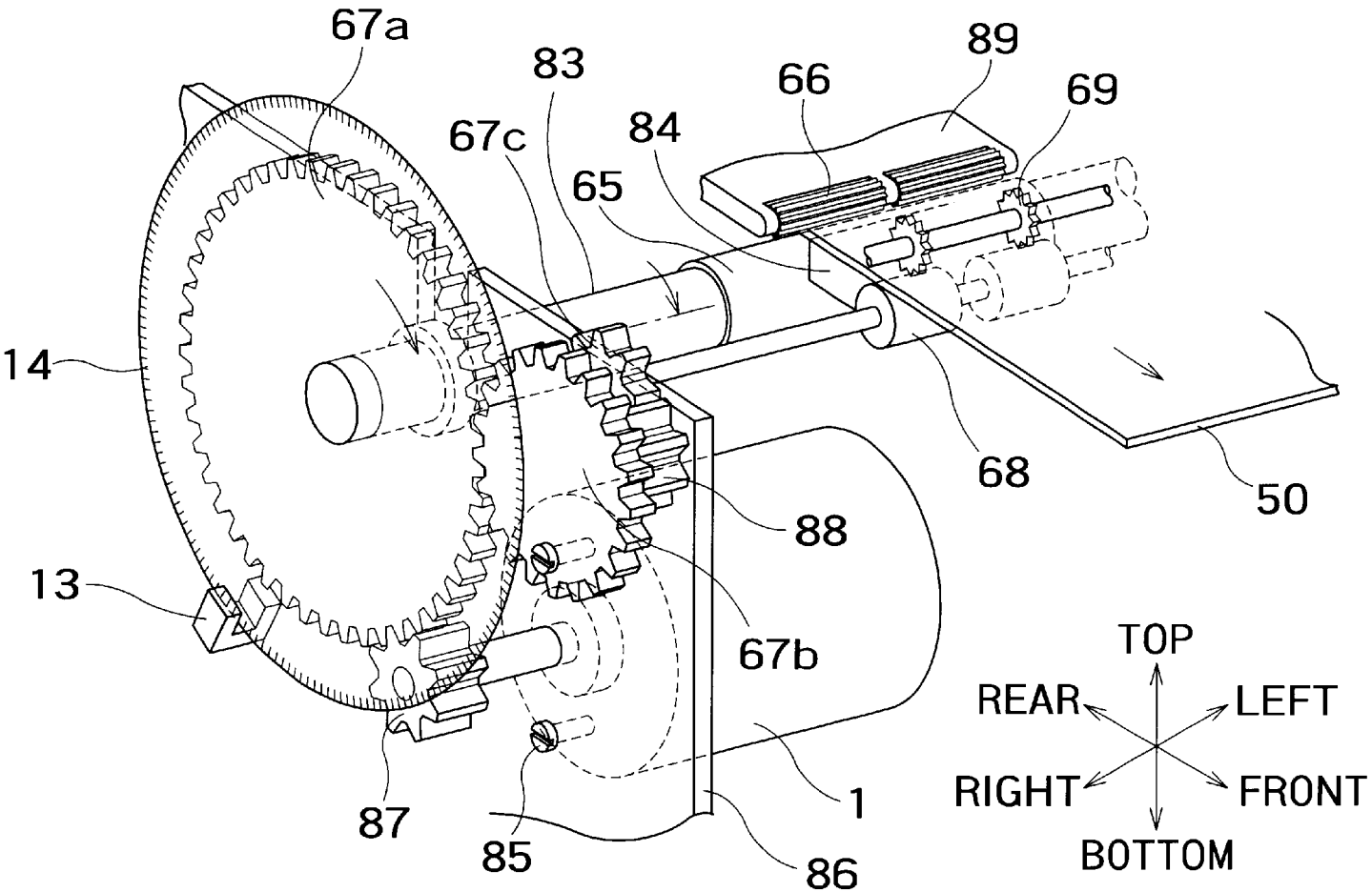
FIG. 6 is a detailed perspective illustration of the paper-feeding mechanism.

FIG. 6 is a detailed perspective illustration of the paper-feeding mechanism.

The paper-feeding mechanism of the printer shown in FIG. 5 is disclosed further in detail with reference to FIGS. 5 and 6.

The paper feed advances with the paper-feed roller 65 and the driven roller 66 on detection of the front edge of the printing paper 50 by the paper sensor 15, which has been inserted into the paper-supply opening 61 and fed into the printer 60 by the paper-supply roller 64. The paper-feed roller 65 is attached on a smap shaft 83, the rotary shaft of a large gear 67*a* driven by the PF motor 1 via a small gear 87. The driven roller 66 is attached to a holder 89 at its tip of the paper-discharging side in a paper-feeding direction. The holder 89 presses the printing paper 50 sent from paper-supplying side in the vertical direction.

The PF motor 1 is mounted on a frame 86 with a screw 85 in the printer 60. The rotary encoder 13 is attached to the large gear 67*a* at its specific position. Coupled to the smap shaft 83, the rotary shaft of the large gear 67*a* is a code disk 14 of the rotary encoder.

The printing paper 50 fed by the paper-feed roller 65 and the driven roller 66 passes on a platen 84 that supports the paper 50 and is fed further by the paper-discharging roller 68 driven by the PF motor 1 via the small gear 87, the large gear 67*a*, an intermediate gear 67*b*, a small gear 88 and the paper-discharging gear 67*c*, and also a driven roller 69 having saw-toothed wheels, and then discharged outside through the paper-discharging opening 62.

While the printing paper 50 is supported on the platen 84, the carriage 3 moves left and right along the guide 32 in a space over the platen 84, ink being sprayed from the print head (not shown) for a printing process.

Explained next is the architecture of DC unit 6, a known DC-motor controller for controlling the CR motor 4 of the inkjet printer described above, and also a printer-control method using the DC unit 6.

Figure 7:
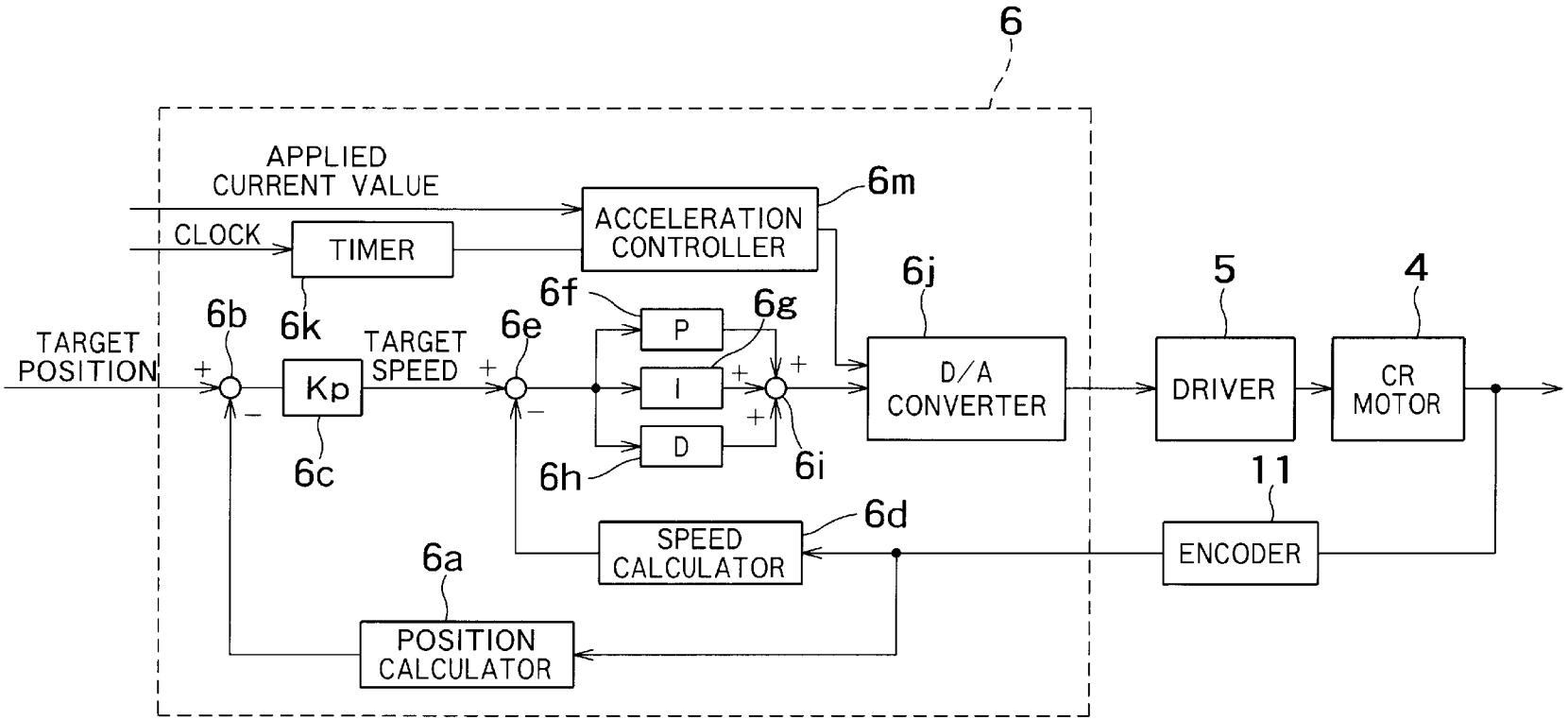
FIG. 7 is a block diagram of a DC unit 6 as a DC-motor controller.
Figures 8A, 8B:
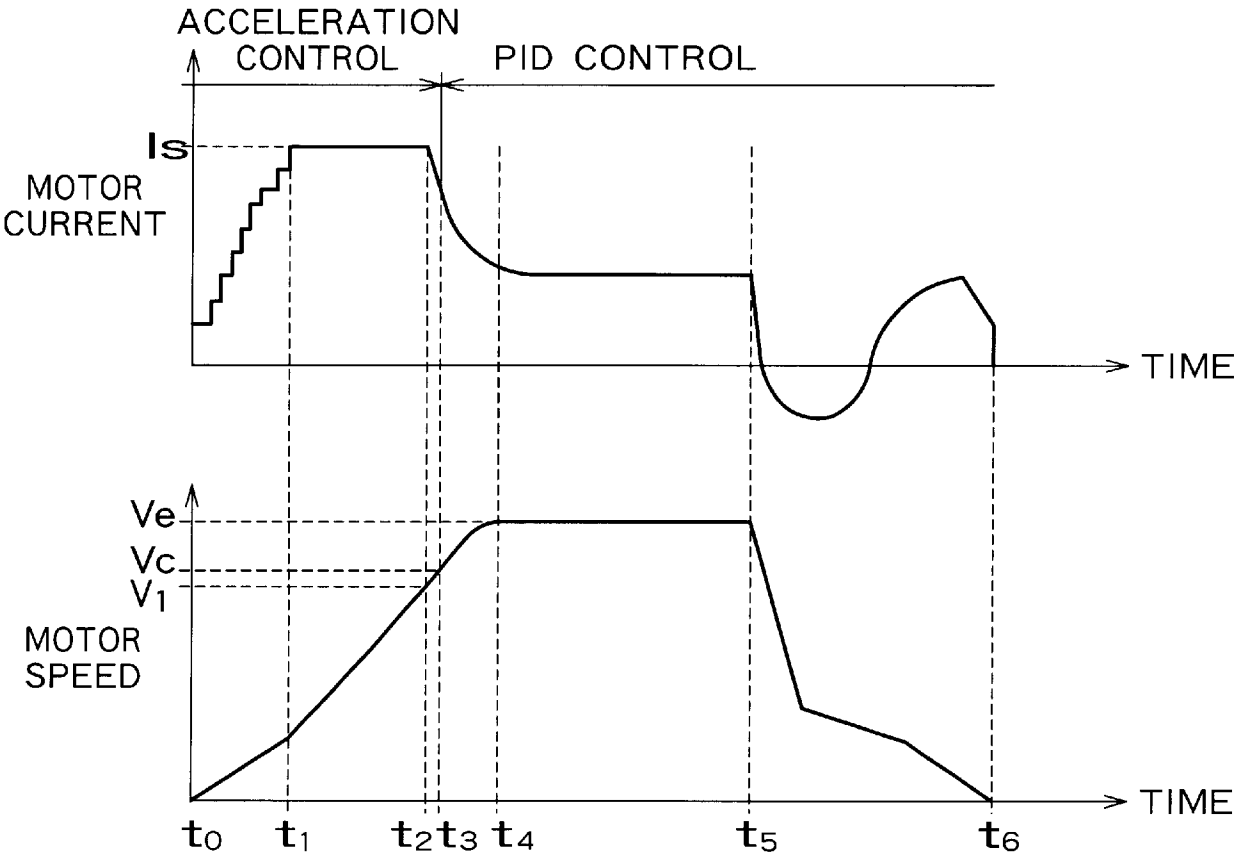
FIGS. 8A and 8B are graphs indicating motor currents and motor speeds for a CR motor 4 controlled by the DC unit 6.

FIG. 7 is a block diagram of the DC unit 6 as a known DC-motor controller. FIGS. 8A and 8B are graphs indicating motor currents and motor speeds for the CR motor 4 controll by the DC unit 6.

The DC unit 6 shown in FIG. 7 is equipped with a position calculator 6*a*, a subtracter 6*b*, a target-speed calculator 6*c*, a speed calculator 6*d*, a subtracter 6*e*, a proportional component 6*f*, an integral component 6*g*, a differential component 6*h*, an adder 6*i*, a D/A converter 6*j*, a timer 6*k* and an acceleration controller 6*m*.

The position calculator 6*a* detects rising and falling edges of each of the output pulses ENA-A and ENA-B of the encoder 11 and counts the number of detected edges to compute the position of the carriage 3 based on the count value. The counting is performed with addition of [+1] on detection of one edge during the normal rotation of the CR motor 4 whereas addition of [−1] on detection of one edge during the reverse rotation of the CR motor 4. The count value [1] corresponds to ¼ of the slit interval on the code disk 12 because the cycle of both pulses ENA-A and ENA-B is equivalent to the slit interval on the code disk 12 and the pulses ENA-A and ENA-B are shifted from each other by 90 degrees in phase. Thus, multiplication of the count value by ¼ of the slit interval gives the amount of movement for the carriage 3 from the position corresponding to a count value [0]. The resolution for the encoder 11 at the given amount of movement corresponds to ¼ of the slit interval on the code disk 12. The resolution is 1/720 inches to a 1/180-inch slit interval.

The subtracter 6*b* calculates a positional deviation of the actual position of the carriage 3 obtained by the position calculator 6*a* from a target position sent from the CPU 16.

The target-speed calculator 6*c* calculates a target speed for the carriage 3 based on the positional deviation, the output of the subtracter 6*b*. This calculation is performed by multiplying the positional deviation by a gain Kp. The gain Kp is decided in accordance with the positional deviation. Several values for the gain Kp may be stored in a table (not shown).

The speed calculator 6*d* calculates a speed of the carriage 3 based on the output pulses ENA-A and ENA-B of the encoder 11. This speed is obtained as follows: The rising and falling edges of the output pulses ENA-A and ENA-B of the encoder 11 are detected and a time interval between the detected edges corresponding to ¼ of the slit interval on the code disk 12 is counted by the timer counter. The carriage speed is then given by ë/4T where ë is the slit interval on the code disk 12 and T is the count value. The speed calculation is performed with measurements, by the timer counter, of one cycle of the output pulse ENA-A, for example, from its specific rising edge to the next rising edge.

The subtracter 6*e* calculates a speed deviation of the actual speed of the carriage 3 calculated by the speed calculator 6*d* from a target speed.

The proportional component 6*f* multiplies the speed deviation by a constant Gp and outputs the result of multiplication. The integral component 6*g* integrates speed deviations each multiplied by a constant Gi. The differential component 6*h* multiplies a difference between the current speed deviation and another speed deviation obtained just before the current speed deviation by a constant Gd and outputs the result of multiplication. The computations at the proportional component 6*f*, the integral component 6*g* and the differential component 6*h* are performed for each cycle of the output pulse ENA-A, for example, in synchronism with each rising edge of the output pulse ENA-A.

The outputs of the proportional component 6*f*, the integral component 6*g* and the differential component 6*h* are added by the adder 6*i*. The result of addition, or a drive current for the CR motor 4 is sent to the D/A converter 6*j* and converted into an analog current. The CR motor 4 is then driven by the driver 5 based on the analog current.

The timer 6*k* and the acceleration controller 6*m* are used for acceleration control. The PID control with the proportional component 6*f*, the integral component 6*g* and the differential component 6*h* is performed for constant-speed control during acceleration and deceleration control.

The timer 6*k* generates a timer-interrupting signal per specific period based on a clock signal sent from the CPU 16.

The acceleration controller 6*m* performs integration by adding a specific current value (for example, 20 mA) to a target current value for each receipt of the timer-interrupting signal. The result of integration, or a target current value for the DC motor 4 during acceleration is sent to the D/A converter 6*j*. Like the PID control, the target current value is converted into an analog current by the D/A converter 6*j*. The CR motor 4 is then driven by the driver 5 based on the analog current.

The driver 5 has, for example, four transistors. Each transistor is turned on or off based on the output of the D/A converter 6*j* for several modes: (a) a driving mode for driving the CR motor 4 in normal or reverse rotation, (b) a regenerative braking mode (short braking mode, a mode for keeping the CR motor at a halt), and (c) a mode for bringing the CR motor to a halt.

Described next with reference to FIGS. 8A and 8B is an operation of the DC unit 6, or a known motor-control method.

The acceleration controller 6*m* supplies a start-up initial current value I0 to the D/A converter 6*j* when a start-up command signal for starting the CR motor 4 is sent from the CPU 16 to the DC unit 6 during the CR motor 4 is keeping at a halt. The start-up initial current value I0 has been sent to the acceleration controller 6*m* from the CPU 16 with the start-up command signal. The start-up initial current value I0 is converted into an analog current by the D/A converter 6*j*. The analog current is then sent to the driver 5 to start the CR motor 4 (as shown in FIGS. 8A and 8B). After receipt of the start-up command signal, the timer 6*k* generates a timer-interrupting signal per specific period. At each receipt of the timer-interrupting signal, the acceleration controller 6*m* performs integration by adding a specific current value (for example, 20 mA) to the start-up initial current value I0. The integrated current value is sent to the D/A converter 6*j*. The integrated current value is then converted into an analog current by the D/A converter 6*j*. The analog current is sent to the driver 5. The driver 5 drives the CR motor 4 to increase the motor speed with the current value supplied to the CR motor 4 equal to the integrated current value (as shown in FIG. 8B). The current value being supplied to the CR motor 4 varies stepwise as shown in FIG. 8A. The D/A converter 6*j* selects and receives the output of the acceleration controller 6*m* while the PID control is also being carried out.

The current-value integration procedure at the acceleration controller 6*m* continues until the integrated current value reaches a constant current value Is. The acceleration controller 6*m* halts the integration procedure when the integrated current value has reached the constant current value Is at the moment t1 and supplies the constant current value Is to the D/A converter 6*j*. The driver 5 thus drives the CR motor 4 with the constant motor-current value Is (as shown in FIG. 8A).

For prevention of the motor speed of the CR motor from overshoot, the acceleration controller 6*m* decreases the current supplied to the CR motor 4 when the motor speed has reached a specific speed V1 (at a moment t2). The speed of the CR motor 4 becomes higher and when it has reached a specific speed Vc (at a moment t3 in FIG. 8B), the D/A converter 6*j* selects the output for PID control, or the output of the adder 6*i* for PID control.

A target speed is calculated based on a positional deviation of the actual position obtained from the output of the encoder 11 from a target position. The proportional component 6*f*, the integral component 6*g* and the differential component 6*h* perform proportional, integral and differential computations, respectively, based on a speed deviation of the actual speed obtained from the output of the encoder 11 from the target speed. The CR motor 4 is then controlled based on the addition of the results of these computations. The proportional, integral and differential computations are performed in synchronism with each rising edge of the output pulse ENC-A of the encoder 11, for example. The DC motor 4 is controlled based on these computations so that the motor speed can be kept at a specific speed Ve. The specific speed Vc is preferably 70 to 80% of the specific speed Ve.

The DC motor 4 is kept at a desired speed from a moment t4 so that the carriage 3 can move at the desired constant speed Ve for a printing process.

When the printing process is completed and the carriage 3 has moved near a target position (at a moment t5 as shown in FIG. 8), the positional deviation and hence the target speed has become small. The speed deviation, or the output of the subtracter 6*e* thus becomes negative, so that the DC motor 4 decelerates to stop at a moment t6.

Explained next with the drawings are PF measurement-executing timing in regular printer-control apparatus and method, and operation and procedure of PF measurements.

Figure 9:
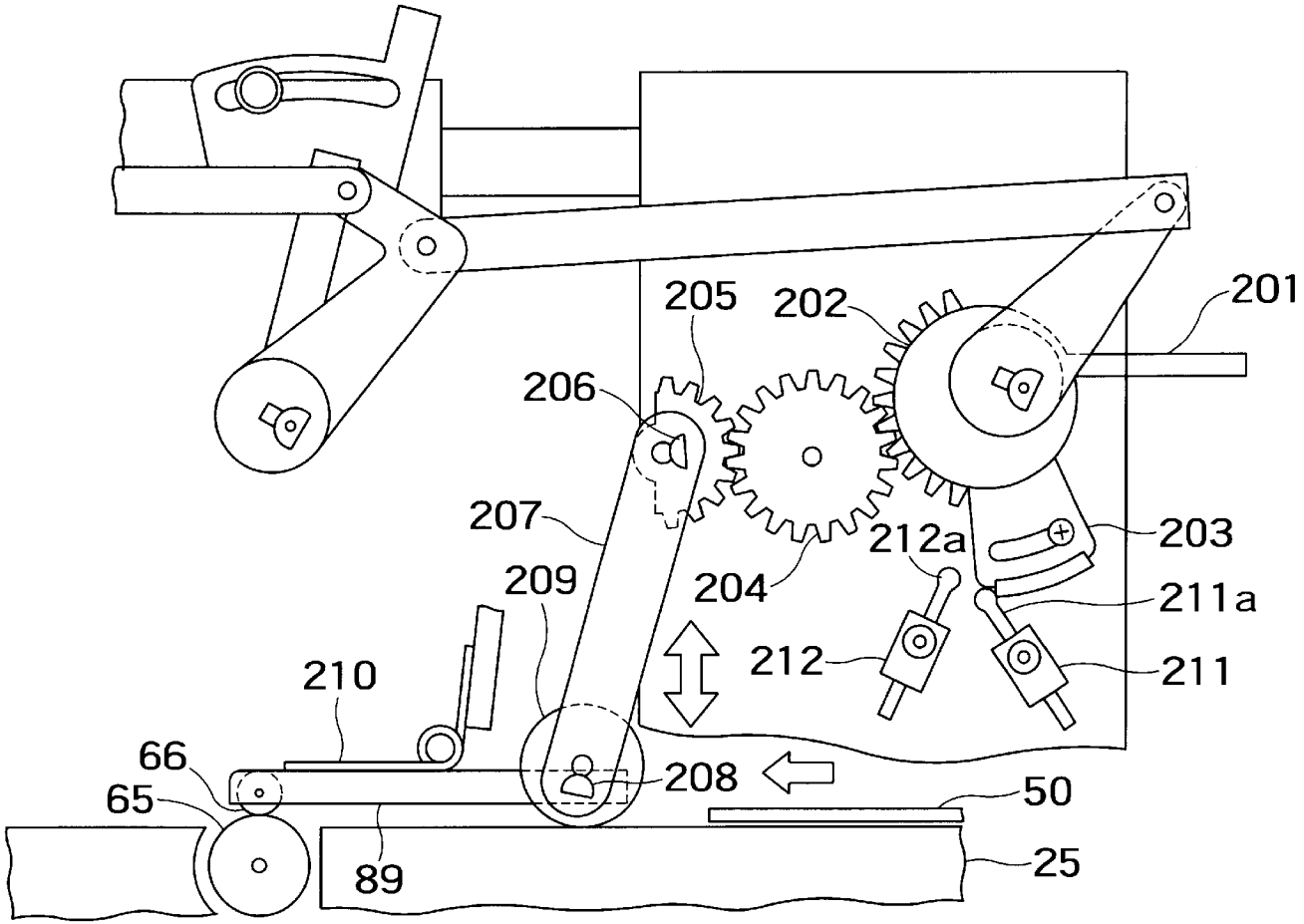
FIG. 9 is a side view showing a paper-gap adjusting mechanism and a release detector installed in a printer.

FIG. 9 is a side view showing a paper-gap adjusting mechanism and a release detector installed in a printer.

An overview structure for the paper-gap adjusting mechanism is as follows: A paper-gap adjusting lever 202 is integrally formed with a gear 202. The gear 202 is meshed with a gear 204 that is also meshed with a gear 205. A link 207 is coupled the gear 205 at its one end with an eccentric bush 206. The link 207 is also coupled to a gear 209 at its other end with an eccentric bush 208. A holder 89 is supported at the eccentric bush 208 so that it can downwardly press a printing paper 50 fed over the platen 25 from the paper-supplying side. In detail, the holder 89 is pressed downwardly with a spring 210 to press the printing paper 50 downwardly. The driven roller 66 is provided at the head of the holder 89 in the paper-discharging side, to face the paper-feed roller 65.

In accordance with the structure, the paper-gap adjuster lever 202 is lifted up or down to rotate the gear 205 via the gear 204, so that the eccentric bush 208 moves up and down via the eccentric bush 206 and the link 207, and hence the holder 89 moves up and down for paper-gap adjustments.

The release detector is installed as follows: The paper-gap adjuster lever 201 is further integrally formed with a fan-like projecting portion 203 together with the gear 202. Release detectors 211 and 212 are provided within a range in which the fan-like projecting portion 203 is rotated when the paper-gap adjuster lever 201 is lifted up or down. In detail, the release detectors 211 and 212 have pins 211*a* and 212*a*, respectively, provided such that their tips are located within the range in which the fan-like projecting portion 203 is rotated. As the fan-like projecting portion 203 is rotated when the paper-gap adjuster lever 201 is lifted up or down, the pins 211*a* and 212*a* gradually turn away, for paper-gap adjustments in the maximum 5 steps, for instance.

Figure 10:
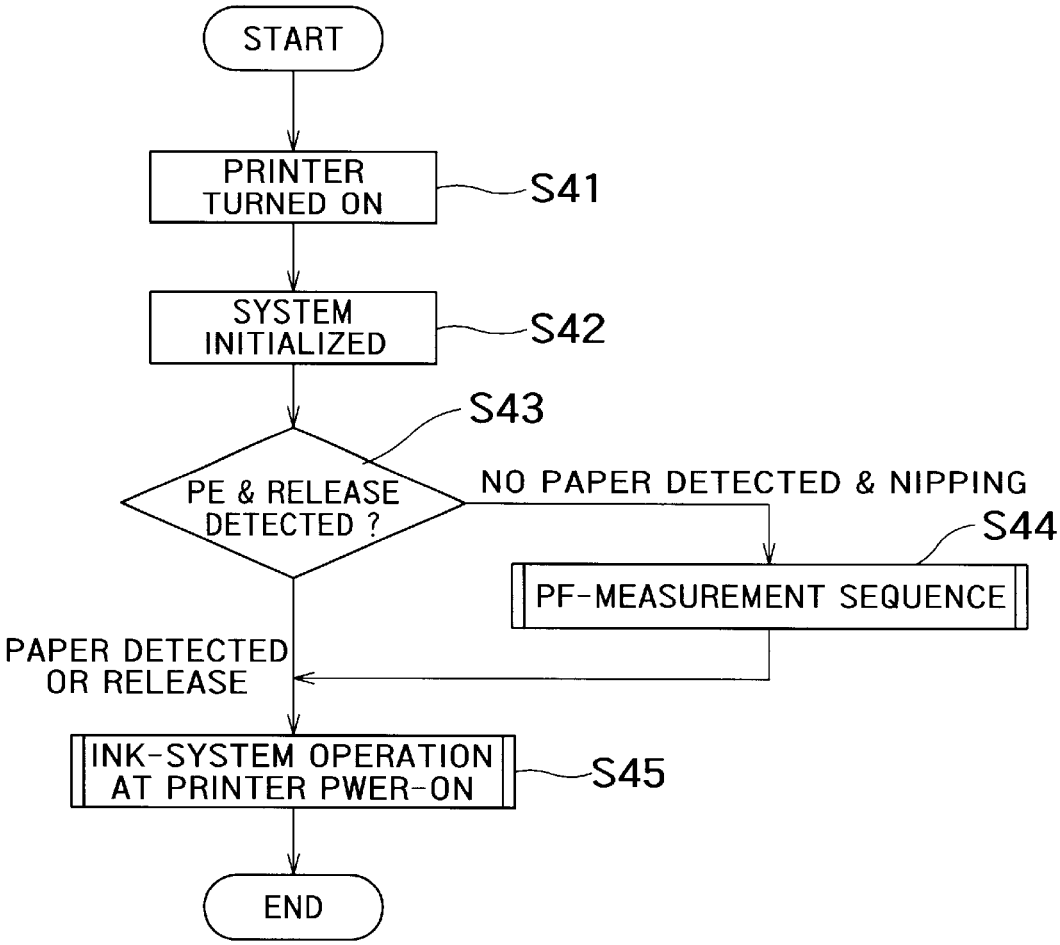
FIG. 10 is a flowchart indicating a procedure of a regular printer-control method to be carried out when a printer is turned on, for performing PF measurements with no printing paper being set in the paper-feeding mechanism.

FIG. 10 is a flowchart indicating an operation of a regular printer-control apparatus to be carried out when a printer is turned on, for performing PF measurements with no printing paper being set in the paper-feeding mechanism, or a procedure of a regular printer-control method to be carried out when a printer is turned on.

When a printer is turned on (step S41), a start-up operation for the carriage and paper-feed driving mechanisms, or a system-initializing operation is performed (step S42).

On system initialization, paper-end (PE) and release detection are performed (step S43). The PF detection is performed by the paper sensor 15. The PF detection usually detects the lower edge of a printing paper, however, the existence of a printing paper in the paper-feeding mechanism in this example. Moreover, the PF measurements are performed in this example with no printing paper being set in the paper-feeding mechanism, or for an empty paper-feeding mechanism.

The release detection is performed to determine whether the paper-feeding mechanism described with reference to FIG. 9 is in a nipping status for paper-feeding for printing papers with thickness within a specific range or in a releasing status for paper-feeding for printing papers with thickness out of the specific range. Explained here is two-step paper-gap adjustments to the paper-feeding mechanism in the nipping or releasing status. The paper-gap adjustments may however be available for three steps or more. As described above, the PF measurements in this example measures a motor-current value in accordance with the load on paper feed and calculates the average of the motor currents based on the integral of the motor currents for an empty paper-feeding mechanism in the nipping status. Applied together with the average motor-current value to paper-feed control is an offset value, a motor-current value into which the load on paper feed, the load generated due to insertion of printing paper into the paper-feeding mechanism, or the load on the paper-feeding mechanism due to the existence of the inserted printing paper only.

In this example, the procedure goes to an ink-system operation at printer power-on (step S45) with no PF measurements when a printing paper has been detected in the paper-feeding mechanism or the release status has been detected for the paper-feeding mechanism as the results of PE and release detection. The ink-system operation at printer power-on is to initialize the ink system including the print head so that the system will be ready for printing.

On the contrary, the procedure goes to the PF measurements in accordance with a specific sequence (step S44) when no printing paper has been detected in the paper-feeding mechanism or the nipping status has been detected for the paper-feeding mechanism. The PF measurements will explained later in detail for the operation and procedure.

After the completion of PF measurements, the procedure goes to the ink-system operation at printer power-on (step S45).

Figure 11:
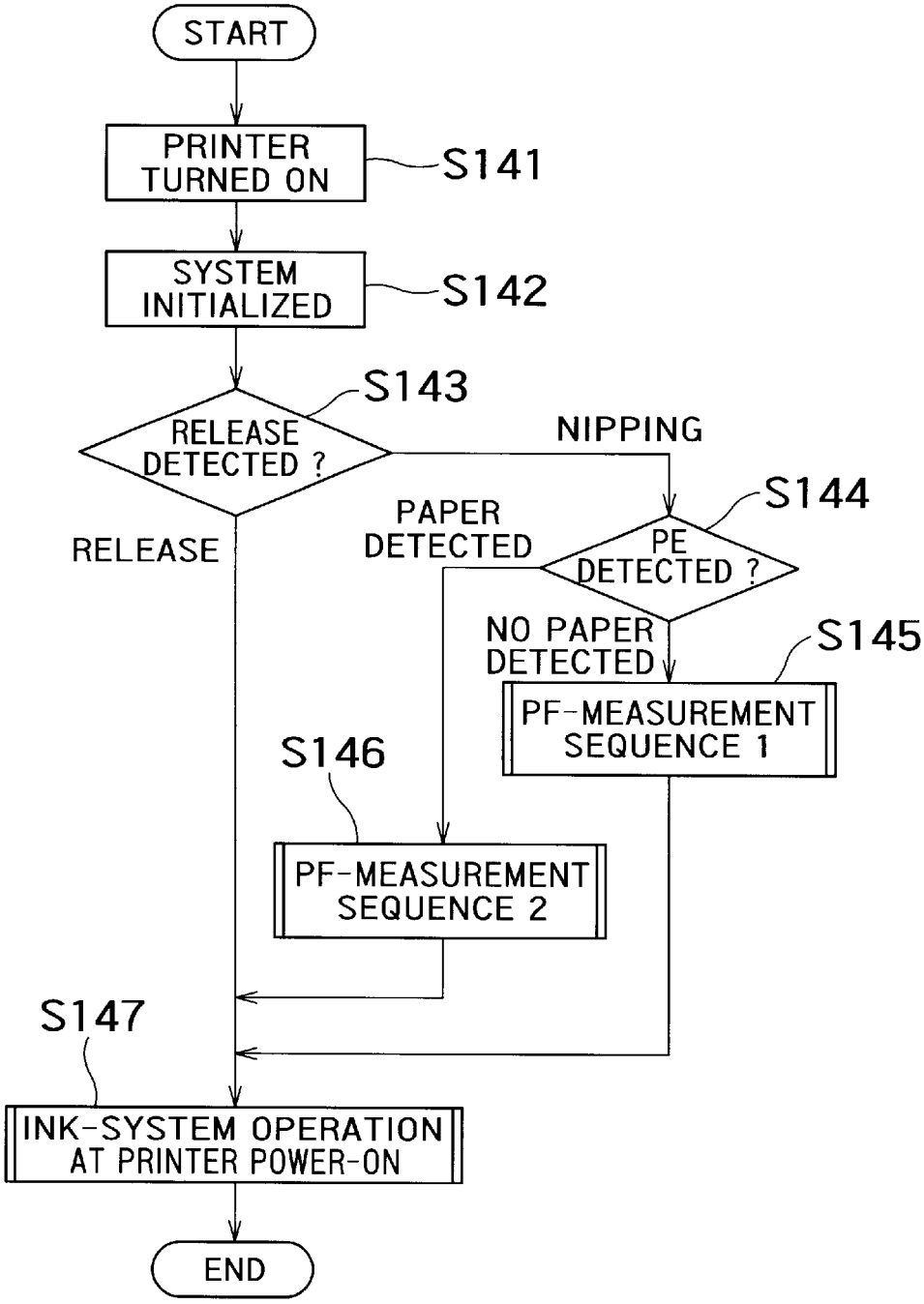
FIG. 11 is a flowchart indicating a procedure of a regular printer-control method to be carried out when a printer is turned on, for performing PF measurements regardless of the existence of printing paper in the paper-feeding mechanism.

FIG. 11 is a flowchart indicating an operation of a regular printer-control apparatus to be carried out when a printer is turned on, for performing PF measurements regardless of the existence of printing paper in the paper-feeding mechanism, or a procedure of a regular printer-control method to be carried out when a printer is turned on.

When a printer is turned on (step S141), a start-up operation for the carriage and paper-feed driving mechanisms, or a system-initializing operation is performed (step S142).

On system initialization, release detection is performed (step S143). Explained here is two-step paper-gap adjustments to the paper-feeding mechanism in the nipping or releasing status. The paper-gap adjustments may however be available for three steps or more. For example, the paper-gap adjustments may be available for 5 steps, such as, small paper gap (nipping), large paper gap, paper gap for envelope, and paper gap for CD-R and release. A PF-measurement sequence for each of the paper-gap adjustments is applied to the PF measurements. In this example, the paper-gap adjustments are made in either the nipping or release status with PF measurements to measure a motor-current value in accordance with the load on paper feeding with or without printing papers in the paper-feeding mechanism in the nipping status and calculate an average motor-current value based on the integral of the measured motor currents. Applied together with the average motor-current value to paper-feed control after the PF measurements with no printing papers in the paper-feeding mechanism is an offset value, a motor-current value into which the load on paper feed, the load generated due to insertion of printing paper into the paper-feeding mechanism, or the load on the paper-feeding mechanism due to the existence of the inserted printing paper only.

In this example, the procedure goes to an ink-system operation at printer power-on (step S147) with no PF measurements when the release status has been detected for the paper-feeding mechanism as the results of release detection. The ink-system operation at printer power-on is to initialize the ink system including the print head so that the system will be ready for printing.

On the contrary, the procedure goes to paper-end (PE) detection (step S144) when the nipping status has been detected for the paper-feeding mechanism as the results of release detection. When no printing paper has been detected in the paper-feeding mechanism as the result of PE detection, the procedure goes to the PF measurements in accordance with a PF-measurement sequence 1 (step S145) for the paper-feeding mechanism with no printing papers being set. The PF measurements will be explained later in detail for the operation and procedure. When a printing paper has been detected in the paper-feeding mechanism as the result of PE detection, the procedure goes to the PF measurements in accordance with a PF-measurement sequence 2 (step S146) for the paper-feeding mechanism with printing papers being set.

After completion of the PF measurements, the procedure goes to the ink-system operation at printer power-on (step S147).

Described so far are the operation and procedure for the regular printer-control apparatus and method. Any type of system-initialization and ink-system operation can be performed and also they are not a must in this example. In other words, the release and PE detection are performed and then PF measurements are performed in accordance with the results of detection at printer power-on for the regular printer-control apparatus and method.

Described next in detail are operation and procedure for PF measurements.

Figure 12:
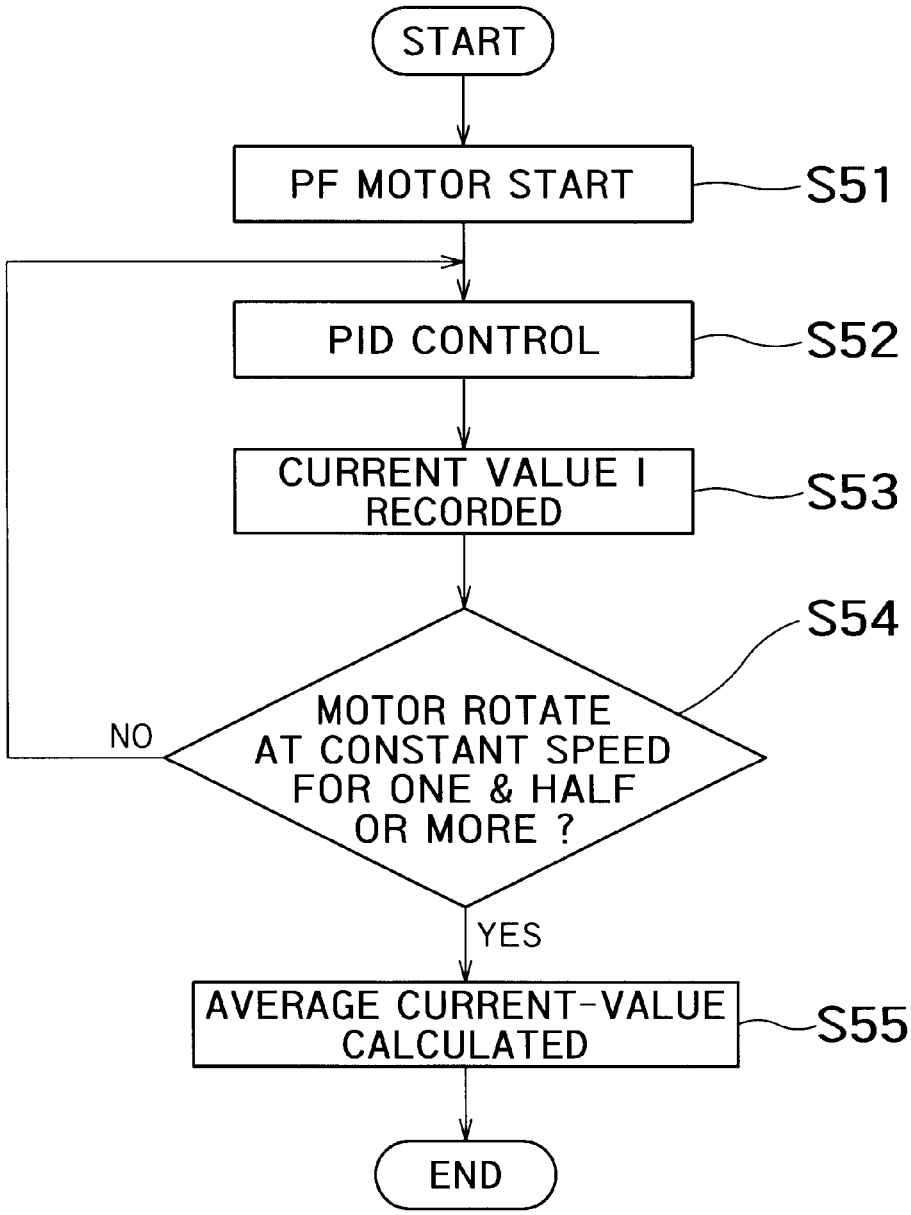
FIG. 12 is a flowchart indicating a procedure of PF measurements.
Figure 13:
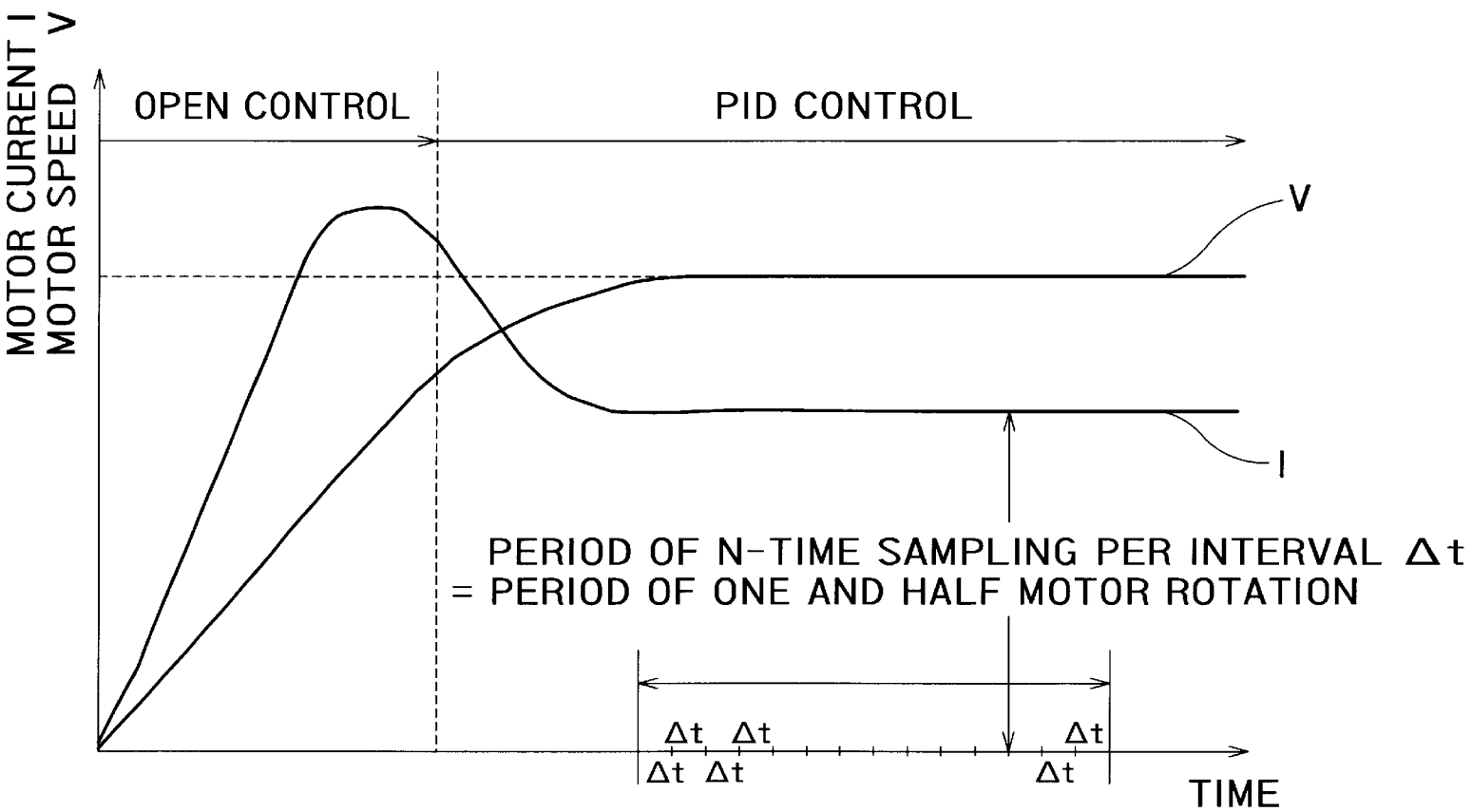
FIG. 13 is a graph indicating motor speeds and motor currents in PF measurements.

FIG. 12 indicates an operation of a printer-control apparatus in PF measurements, or a flowchart for a printer-control method in PF-measurement procedure. FIG. 13 is a graph indicating motor speeds and motor currents in the PF measurements.

The PF measurements are performed as follows: A paper-feed motor is started (step S51) and accelerated by acceleration control under open-loop control until a motor speed V approaches a specific constant speed.

Once the motor speed V has approached a specific constant speed, the open-loop control is switched to PID control for constant-speed driving (step S52). As shown in graphs in FIG. 13, a motor current I is kept at a almost constant value during constant-speed driving under the PID control.

Once the motor current I has been kept at almost the constant value, recording of the current value I, or sampling of current value I per time interval Ät is started (step S53). The current-value recording or sampling starts when the paper-feed motor has been driven at constant speed under the PID control, continues until the paper-feed motor has rotated for one and half revolution or more (step S54). The number of motor-revolution for the period of recording current-value I can be decided in accordance the interval and the number of current-value sampling. In this example, as shown in FIG. 13, for N-time sampling per interval Ät, the current-value sampling is performed for each interval Ät to record each current value after the paper-feed motor has been driven at constant speed and until it has rotated for one and half revolution when the period of N-time sampling per interval Ät is equal to the period of one and half revolution for the paper-feed motor.

During the recording of current value I, an integral value is calculated from each current value I and the sampling interval Ät for each motor-current sampling at the interval Ät, and accumulated.

When the recording of current value I is completed by N-time sampling at the interval Ät while the paper-feed motor has rotated for one and half revolution, the total of N integral values of current value I is calculated and the total is divided by Ät×N (length of period for recording current value I) to obtain an average motor current value /I (the symbol "/" means an average value) in accordance with the load on the paper-feed motor at constant-speed driving (step S55).

The PF measurements are then brought in a halt. The average motor-current value obtained through the PF measurements is stored in a memory for updating. Also having been stored in this memory or another memory is a motor-current value as an offset value in accordance with the load on paper feeding generated only when a printing paper exists. The average motor-current value obtained through the PF measurements with no printing paper being set in the paper-feeding mechanism will be used with the offset value. On the contrary, an average motor-current value obtained through the PF measurements with printing papers being set in the paper-feeding mechanism will be used without offset values. Such average motor-current value offers a stable and accurate current control, particularly, at a small amount in one-time paper feeding action.

Disclosed next with reference to the drawings are embodiments of printer-control apparatus and method and storage medium storing a computer program for executing the printer-control method according to the present invention.

The feature of the printer-control apparatus and method according to the present invention lies in PF measurements at the time printer power-on and also other occasions, which is available only at printer power-on in the known printer-control apparatus and method. This feature offers a precise control of a paper-feed motor for driving a paper-feeding mechanism even at a small paper-feeding amount in one-time paper feeding action for printers to be used in several environments, for example, use for 24 hours or a long period of time.

Figure 14:
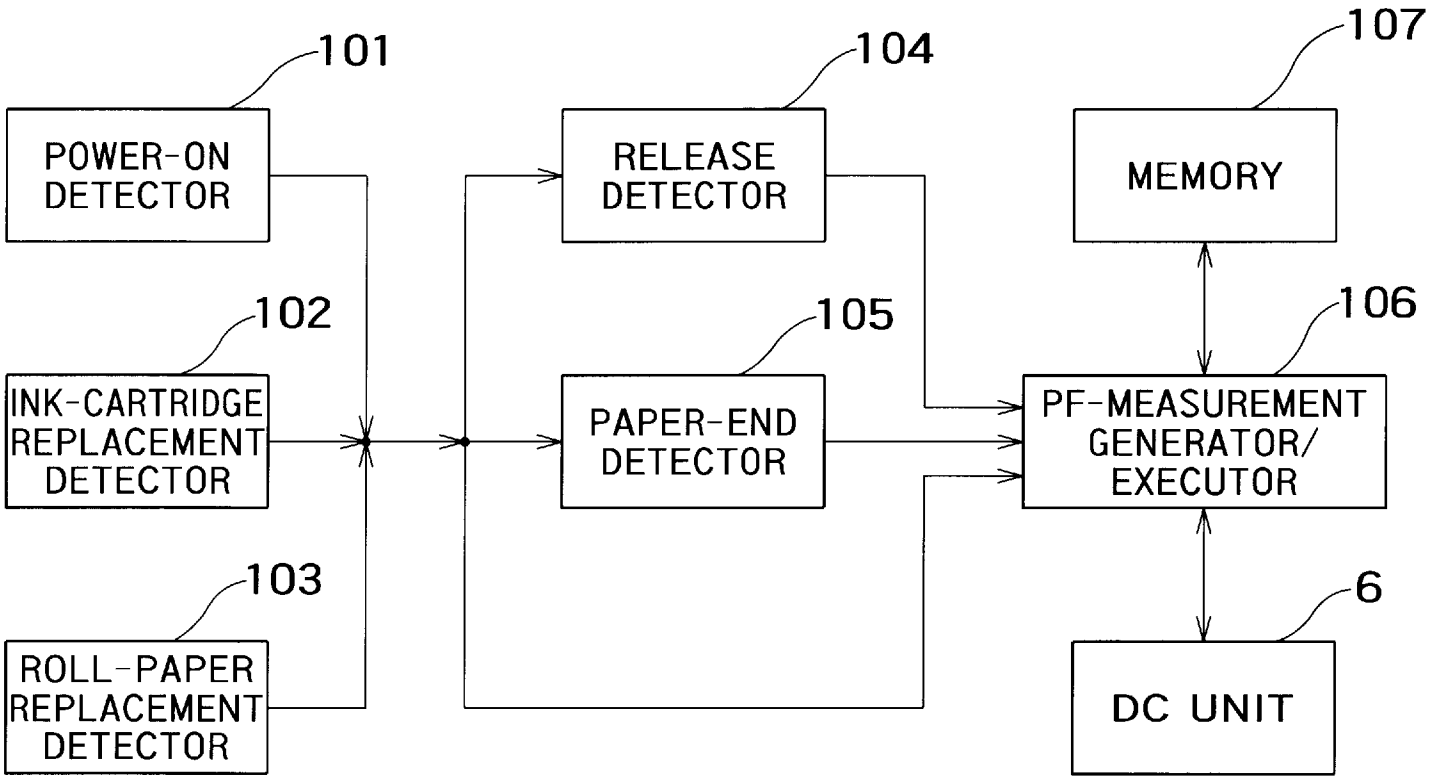
FIG. 14 is a block diagram of a printer-control apparatus according to the present invention.

FIG. 14 is a block diagram of a printer-control apparatus according to the present invention. The printer-control apparatus is equipped with the following components: a power-on detector 101 for detecting printer power on; an ink-cartridge replacement detector 102 for detecting the replacement of an ink cartridge; a roll-paper replacement detector 102 for detecting the replacement of a roll printing paper; a release detector 104 for determining whether a paper-feeding mechanism is in a nipping status for feeding printing papers within a specific thickness range or in a release status for feeding printing papers out of the specific thickness range in response to the detection of printer power-on, ink-cartridge replacements or roll-paper replacements; an paper-end detector for determining whether any printing paper has been set in the paper-feeding mechanism in response to the detection of printer power-on, ink-cartridge replacements or roll-paper replacements; a PF-measurement generator/executing unit 106 for generating and executing operations for PF measurements to measure motor current in accordance with the load on paper feeding for a paper-feed motor at constant-speed driving and calculate an average motor-current value in response to the detection of printer power-on, ink-cartridge replacements or roll-paper replacements, and detection of nipping status and existence or no existence of printing paper in the paper-feeding mechanism; and a memory 107 for storing integral motor-current values obtained through the PF measurements one by one for accumulation and updating the average motor-current value also obtained through the PF measurements. The release detector 104 corresponds to the release detectors 211 and 212 shown in FIG. 9.

The printer-control apparatus and method according to the present invention perform PF measurements at printer power-on and also when either the ink-cartridge or roll-paper replacements is detected. The printer-control apparatus and method according to the present invention perform PF measurements in response to printer power-on detection by the power-on detector 101 in the same way as the known printer-control apparatus and method described above in operation and procedure, and hence the disclosure being omitted here for brevity.

Figure 15:
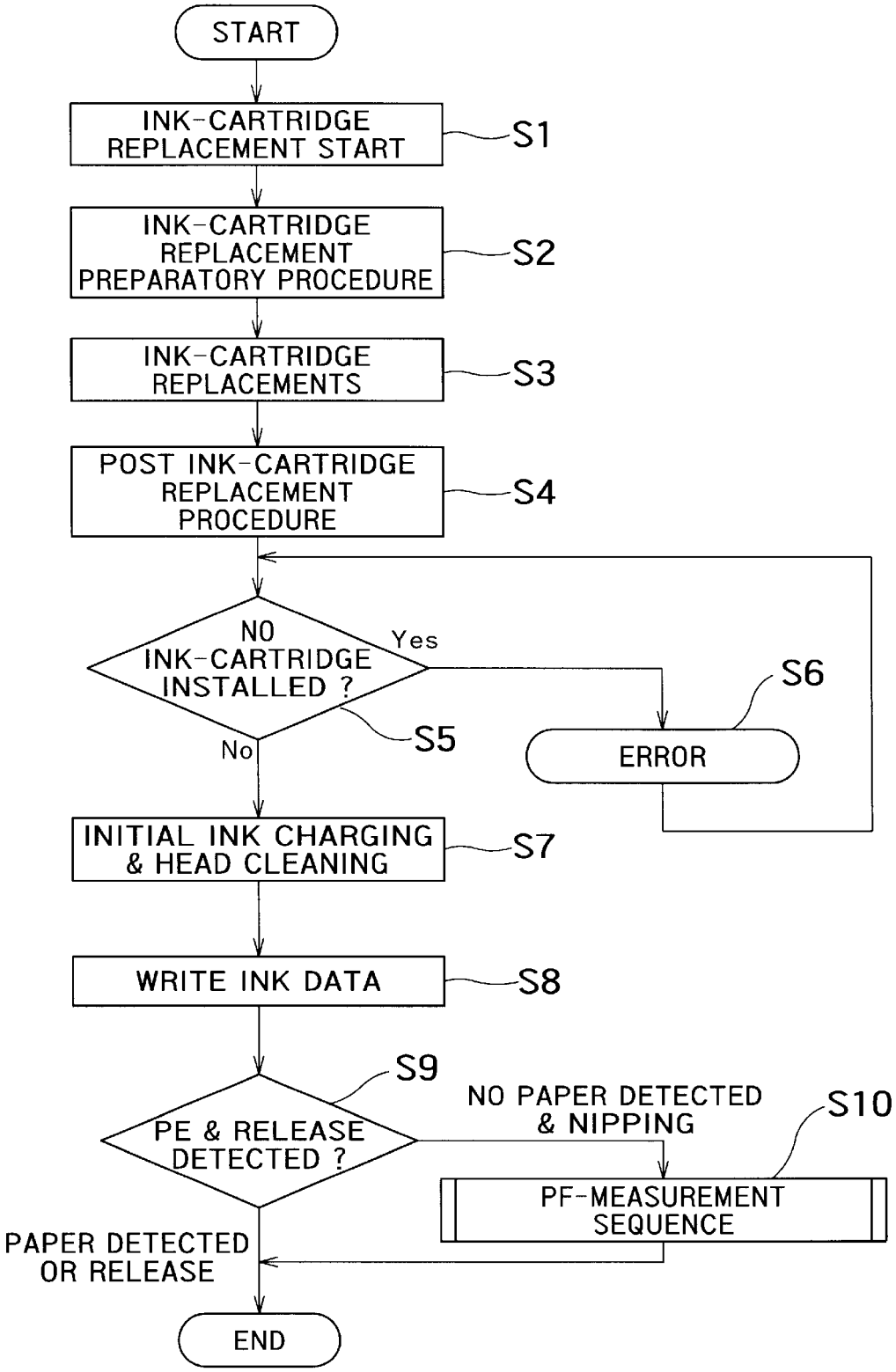
FIG. 15 is a flowchart indicating a procedure of a printer-control method of the present invention to be carried out at the time of ink-cartridge replacements, for performing PF measurements with no printing paper being set in the paper-feeding mechanism.

FIG. 15 is a flowchart indicating an operation of the printer-control apparatus of the present invention to be carried out at the time of ink-cartridge replacements, for performing PF measurements with no printing paper being set in the paper-feeding mechanism, or a procedure of the printer-control method of the present invention to be carried out at the time of ink-cartridge replacements. The flowchart shown in FIG. 15 indicates an operation of a printer in addition to an operation of the printer-control apparatus for the sake of the disclosure.

Disclosed with reference to FIGS. 14 and 15 are an operation of the printer-control apparatus of the present invention to be carried out at the time of ink-cartridge replacements, for performing PF measurements with no printing paper being set in the paper-feeding mechanism, or a procedure of the printer-control method of the present invention to be carried out at the time of ink-cartridge replacements.

When an ink-cartridge replacement has started in response to an ink-cartridge replacement command due to out of ink, etc., (step S1), an ink-cartridge replacement preparatory procedure is performed for driving a printer carriage to an ink-cartridge replacement position, etc., (step S2).

On completion of the ink-cartridge replacement preparatory procedure and hence the ink-cartridge replacement is ready, ink-cartridge replacements are performed (step S3).

On completion of the ink-cartridge replacements, a post ink-cartridge-replacement procedure is performed such as driving the carriage to the initial position and ink-amount checking to the newly set ink cartridge (step S4).

On completion of the post ink-cartridge-replacement procedure, the ink-cartridge replacement detector 102 checks the existence of an ink-cartridge, or determines whether an ink cartridge has been installed (step S5). If no ink cartridge has been installed, error and ink-cartridge installation messages are indicated by a lamp on the printer or displayed on a computer monitor-screen connected to the printer.

On the contrary, if an ink cartridge has been installed, an initial ink-charging and head-cleaning procedures are performed according to need before PF measurements described later (step S7). The initial ink-charging procedure is to suck air from an ink-flow passage from an ink-flow opening of an ink cartridge to head nozzles and charging ink in the passage. The head-cleaning procedure is to suck used ink from the head nozzles if plugged and charging new ink to the nozzles.

On completion of the initial ink-charging and head-cleaning procedures, ink data is written into an ink remaining-amount managing IC memory installed in the ink cartridge for updating data on the amount of ink remaining in accordance with the amount of ink used for the initial ink-charging and head-cleaning procedure (step S8).

On completion of the ink-data storing and updating, PE and release detection are performed to determine whether the printer is ready for PF measurements (step S9). The PE detection is performed by the paper-end detector 105 to determine whether any printing paper has been set in the printer paper-feeding mechanism. The paper detector 15 shown in FIG. 5 can be used as the paper-end detector 105.

The release detection is performed by the release detector 104 (the release detectors 211 and 212 in FIG. 9) to determine whether the paper-feeding mechanism is in a nipping status for feeding printing papers within a specific thickness range or in a release status for feeding printing papers out of the specific thickness range.

If determined that a printing paper has been set in the printer paper-feeding mechanism or the paper-feeding mechanism is in the release status, as the results of PE and release detection, a series of operations for ink-cartridge replacements are brought into a halt with no PF measurements.

On the contrary, if determined that no printing paper has been set in the printer paper-feeding mechanism and the paper-feeding mechanism is in the nipping status, as the results of PE and release detection, PF measurements are performed under a specific sequence (step S10). The detailed operation and procedure of the PF measurements are already described as above. On completion of PF measurements, a series of operations for ink-cartridge replacements are brought into a halt.

Figure 16:
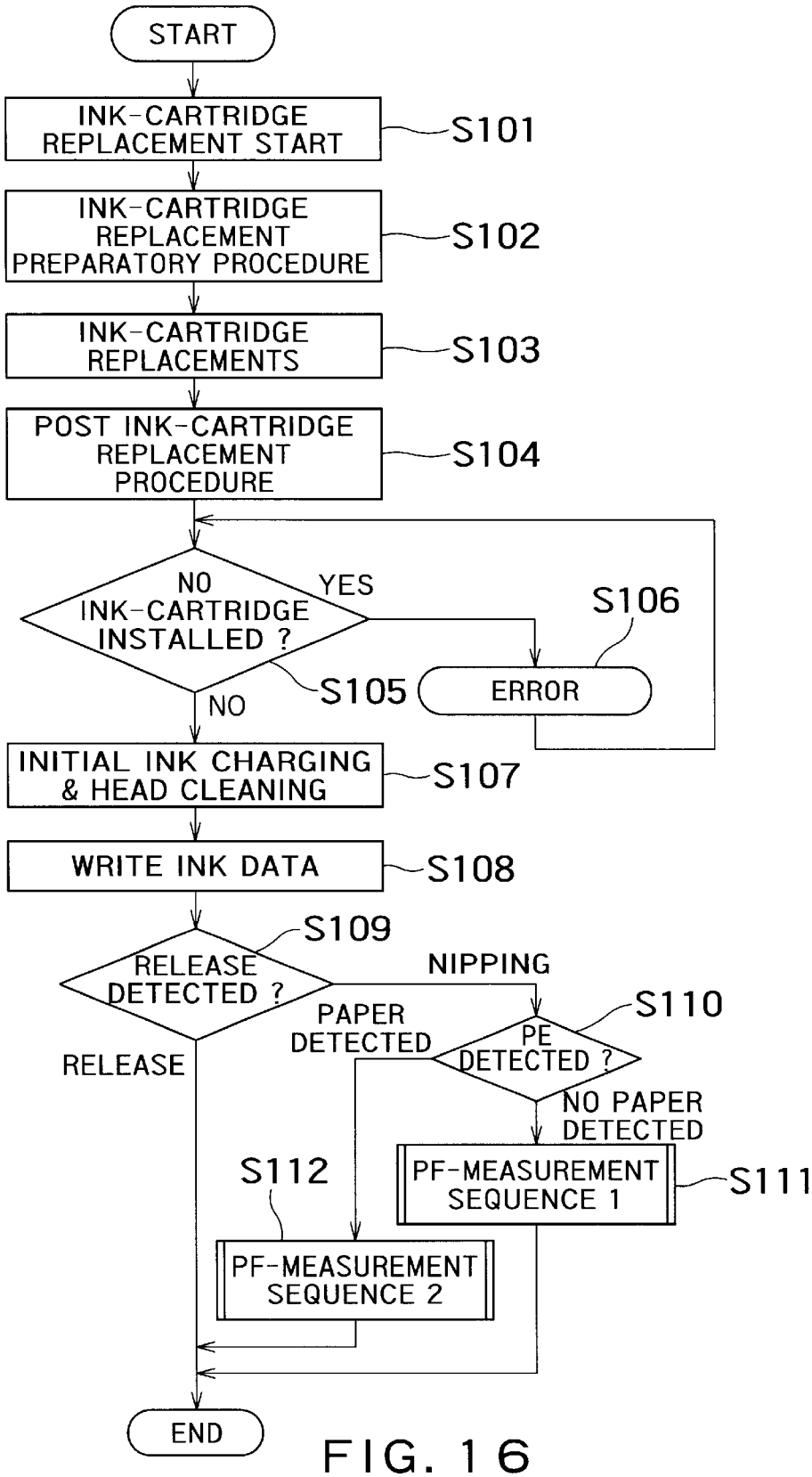
FIG. 16 is a flowchart indicating a procedure of a printer-control method of the present invention to be carried out at the time of ink-cartridge replacements, for performing PF measurements regardless of the existence of printing paper in the paper-feeding mechanism.

FIG. 16 is a flowchart indicating an operation of the printer-control apparatus of the present invention to be carried out at the time of ink-cartridge replacements, for performing PF measurements regardless of the existence of printing paper in the paper-feeding mechanism, or a procedure of the printer-control method of the present invention to be carried out at the time of ink-cartridge replacements. The flowchart shown in FIG. 16 indicates an operation of the printer in addition to an operation of the printer-control apparatus for the sake of the disclosure.

Disclosed with reference to FIGS. 14 and 16 are an operation of the printer-control apparatus of the present invention to be carried out at the time of ink-cartridge replacements, for performing PF measurements regardless of the existence of printing paper in the paper-feeding mechanism, or a procedure of the printer-control method of the present invention to be carried out at the time of ink-cartridge replacements.

Steps S101 to S108 in the flowchart shown in FIG. 16 are the same as steps S1 to S8 in the flowchart shown in FIG. 14, and hence the disclosure being omitted for brevity.

A series of operations directly related ink-cartridge replacements are performed (steps S101 to S108) and then release detection is performed (step S109) for the PF measurements in the flowchart shown in FIG. 16 regardless of the existence of printing paper in the paper-feeding mechanism.

If determined that the printer paper-feeding mechanism is in the release status, as the result of release detection, a series of operations for ink-cartridge replacements are brought into a halt with no PF measurements.

On the contrary, PE detection is performed (step S110) if determined that the printer paper-feeding mechanism is in the nipping status, as the result of release detection. When no printing paper has been detected in the paper-feeding mechanism as the result of PE detection, the procedure goes to the PF measurements in accordance with a PF-measurement sequence 1 (step S111) for a paper-feeding mechanism with no printing papers being set. When a printing paper has been detected in the paper-feeding mechanism as the result of PE detection, the procedure goes to the PF measurements in accordance with a PF-measurement sequence 2 (step S112) for a paper-feeding mechanism with printing papers being set. The detailed operation and procedure of the PF measurements have already been described as above.

Explained here is two-step paper-gap adjustments to the paper-feeding mechanism in the nipping or release status. The paper-gap adjustments may however be available for three steps or more. For example, the paper-gap adjustments may be available for 5 steps such as small paper gap (nipping), large paper gap, paper gap for envelope, paper gap for CD-R and release. The operation and procedure in steps S109 to S112 in the flowchart shown in FIG. 16 are performed for each of the paper-gap adjustments. In detail, it is determined in release detection which of the paper-gap adjustments has been made, and then the PF measurements are performed with the PF-measurement sequence corresponding to the detected paper-gap adjustment and the existence of printing paper in the paper-feeding mechanism.

On completion of the PF measurements, a series of operations for ink-cartridge replacements are brought into a halt.

Disclosed so far are the operations and procedures of the printer-control apparatus and method according to the present invention in ink-cartridge replacements. Any types of operations and procedures can be applied, if directly related to ink-cartridge replacements. In other words, release and PE detection are performed and then the PF measurements are performed in accordance with the results of the detection in the printer-control apparatus and method according to the present invention for ink-cartridge replacements.

Figure 17:
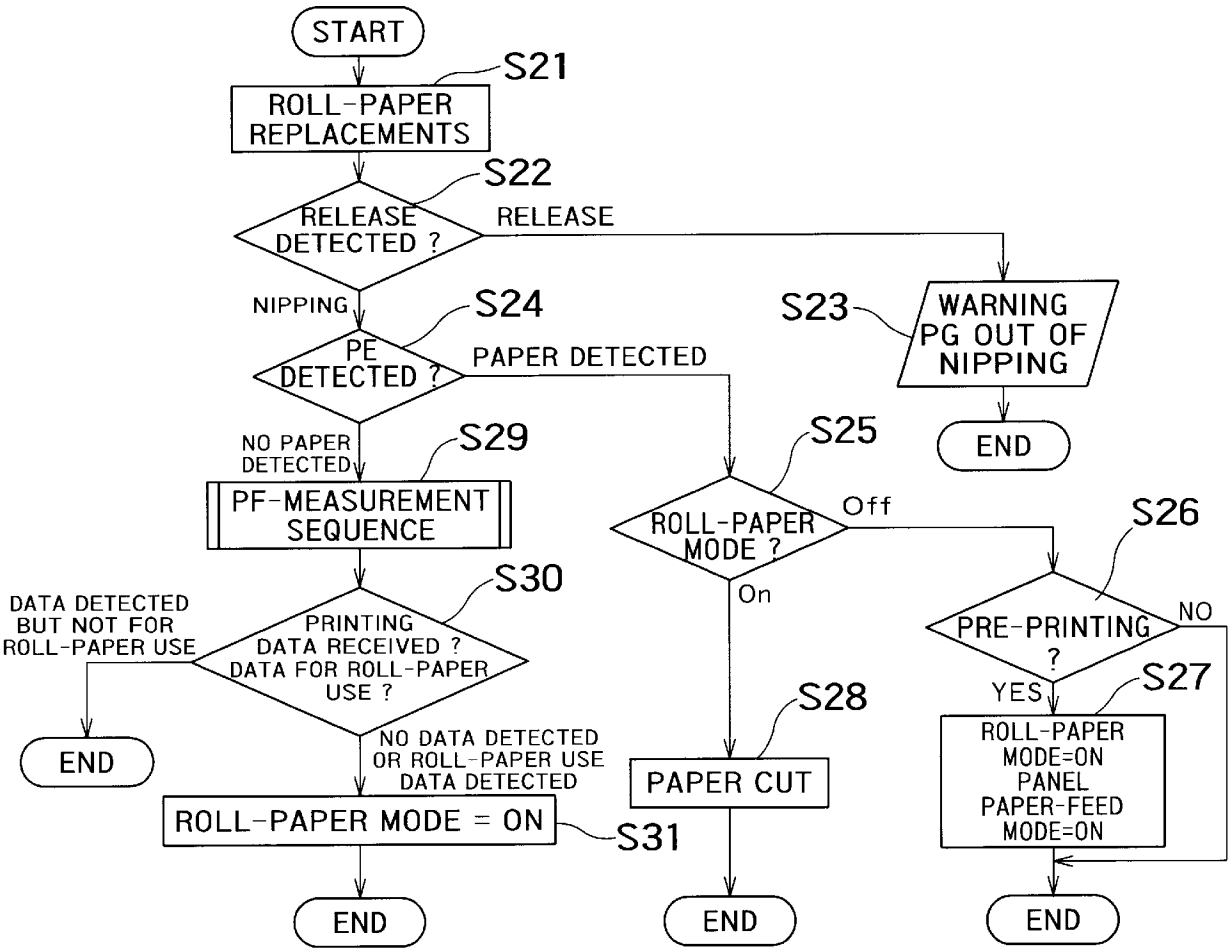
FIG. 17 is a flowchart indicating a procedure of a printer-control method of the present invention to be carried out at the time of roll-paper replacements, for performing PF measurements with no printing paper being set in the paper-feeding mechanism.

FIG. 17 is a flowchart indicating an operation of a printer-control apparatus of the present invention to be carried out at the time of roll-paper replacements, for performing PF measurements with no printing paper being set in the paper-feeding mechanism, or a procedure of a printer-control method of the present invention to be carried out at the time of roll-paper replacements. The flowchart shown in FIG. 17 indicates an operation of the printer in addition to an operation of the printer-control apparatus for the sake of the disclosure.

Disclosed with reference to FIGS. 14 and 17 is the operation of the printer-control apparatus of the present invention to be carried out at the time of roll-paper replacements, for performing PF measurements with no printing paper being set in the paper-feeding mechanism, or the procedure of the printer-control method of the present invention to be carried out at the time of roll-paper replacements.

When the replacement of a roll printing paper is detected by the roll-paper replacement detector 103 (step S21), the following release and PE detection (steps S22 and S24) are performed to determine whether the printer is ready for the PF measurements disclosed later.

The release detection is performed by the release detector 104 (release detectors 211 and 212 shown in FIG. 9) to determine whether the paper-feeding mechanism is in the nipping status (step S22).

If determined that the paper-feeding mechanism is in the release status, as the results of release detection, the PF measurements and the subsequent roll-paper printing are prohibited. A warning that indicates the release status for the paper-feeding mechanism, which is the status other than the nipping status for a paper gap (PG) as a gap formed at a specific location in the paper-feeding mechanism, corresponding to paper thickness allowable for paper feeding, is indicated by the lamp on the printer or displayed on the computer monitor-screen connected to the printer (step S23).

On the contrary, if determined that the paper-feeding mechanism is in the nipping status, as the result of release detection, PE detection is performed by the paper-end detector 105 to determine whether any printing paper has been set in the paper-feeding mechanism (step S24). The paper sensor 15 shown in FIG. 5 can be used as the paper-end detector 105.

If determined that a printing paper has been set in the paper-feeding mechanism as the result of PE detection, it is determined whether the printer has been set in a roll-paper mode with no PF measurements (step S25).

If the roll-paper mode is off, it is further determined whether printing has not started (step S26). It continues if already started whereas if not started yet, the roll-paper mode is set on whereas a panel paper-supplying mode for feeding regular papers other than the roll paper is set off (step S27).

On the contrary, if a printing paper has been set in the paper-feeding mechanism and the roll-paper mode is on, a cutting procedure is performed to cut a printed part of the roll paper or unnecessary tip part of the paper (step S28). The cutting procedure usually includes a series of operations of cutting the roll paper at a cutting portion set under a cutter by paper feeding and then returning the tip of the cut roll paper to a specific position between the head and platen.

If no printing paper has been set in the paper-feeding mechanism as the result of PE detection, the PF measurements are performed under a specific sequence (step S29). The detailed operations and procedures of the PF measurements have already described as above.

On completion of the PF measurements, it is determined whether there is printing data already received and the printing data is for use in roll-paper printing (step S30).

If there is printing data already received but it not for use in roll-paper printing, the procedures are brought into a halt with no printing process due to mismatching between the printing paper and the received data. The mismatching may be indicated by the lamp on the printer or displayed on the computer monitor-screen connected to the printer.

On the contrary, if there is no printing data already received or there is printing data already received and it is for use in roll-paper printing, a roll-paper mode is set on for execution of roll-paper printing (step S31) and the procedures are brought into a halt. The roll-paper printing is executed thereafter if needed.

Figure 18:
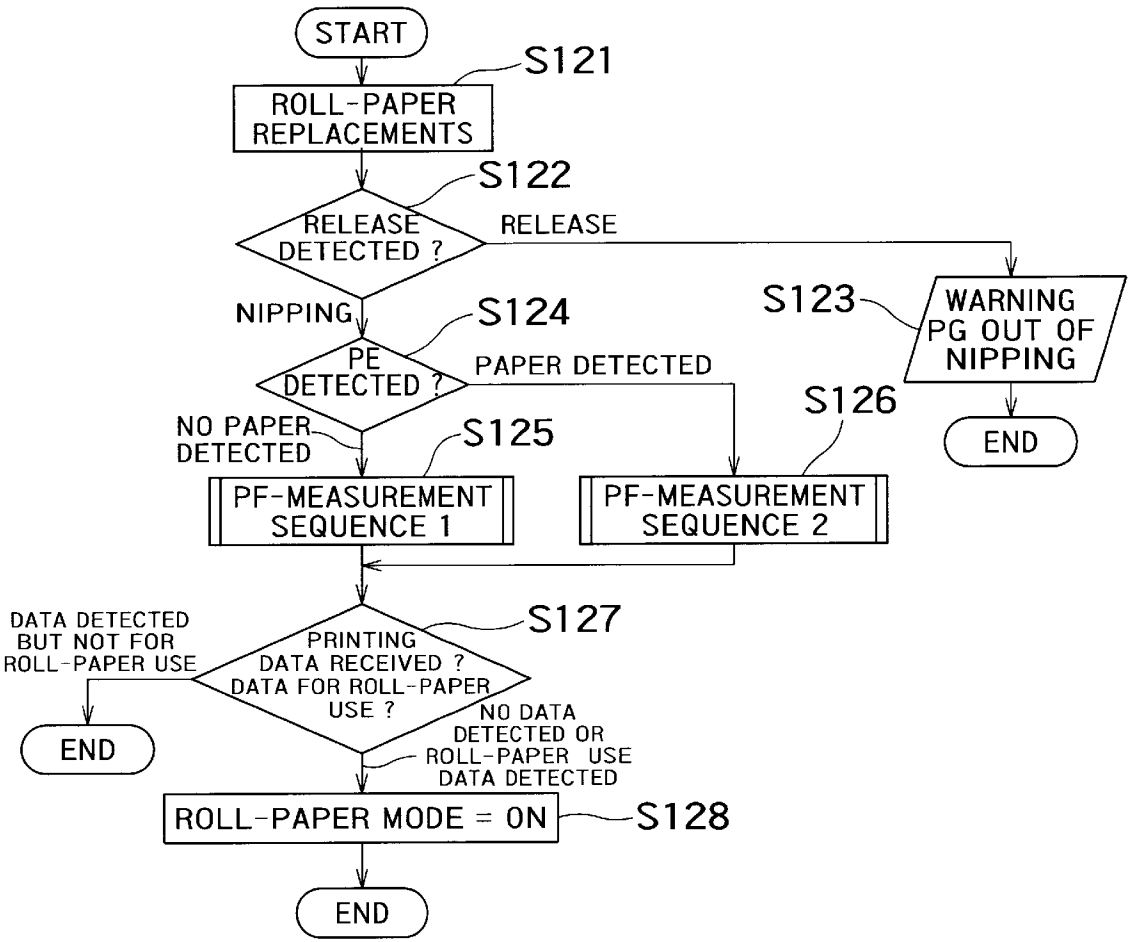
FIG. 18 is a flowchart indicating a procedure of a printer-control method of the present invention to be carried out at the time of roll-paper replacements, for performing PF measurements regardless of the existence of printing paper in the paper-feeding mechanism.

FIG. 18 is a flowchart indicating an operation of a printer-control apparatus of the present invention to be carried out at the time of roll-paper replacements, for performing PF measurements regardless of the existence of printing paper in the paper-feeding mechanism, or a procedure of a printer-control method of the present invention at the time of roll-paper replacements. The flowchart shown in FIG. 18 indicates an operation of the printer in addition to an operation of the printer-control apparatus for the sake of the disclosure.

Disclosed with reference to FIGS. 14 and 18 is the operation of the printer-control apparatus of the present invention to be carried out at the time of roll-paper replacements, for performing PF measurements regardless of the existence of printing paper being set in the paper-feeding mechanism, or the procedure of the printer-control method of the present invention to be carried out at the time of roll-paper replacements.

When the replacement of a roll printing paper is detected by the roll-paper replacement detector 103 (step S121), the following release detection (steps S122) is performed to determine whether the printer is ready for the PF measurements disclosed later. The release detection is performed by the release detector 104 (release detectors 211 and 212 shown in FIG. 9) to determine whether the paper-feeding mechanism is in the nipping status (step S212).

If determined that the paper-feeding mechanism is in the release status, as the results of release detection, the PF measurements and the subsequent roll-paper printing are prohibited. A warning that indicates the release status for the paper-feeding mechanism, which is the status other than the nipping status for a paper gap (PG) as a gap formed at a specific location in the paper-feeding mechanism, corresponding to paper thickness allowable for paper feeding, is indicated by the lamp on the printer or displayed on the computer monitor-screen connected to the printer (step S123).

On the contrary, if determined that the paper-feeding mechanism is in the nipping status, as the results of release detection, PE detection is performed by the paper-end detector 105 to determine whether any printing paper has been set in the paper-feeding mechanism (step S124). The paper sensor 15 shown in FIG. 5 can be used as the paper-end detector 105.

If no printing paper has been set in the paper-feeding mechanism, the PF measurements are performed under the PF-measurement sequence 1 (step S125). Contrary to this, if a printing paper has been set in the paper-feeding mechanism, the PF measurements are performed under the PF-measurement sequence 2 (step S126). The detailed operations and procedures of the PF measurements have already described as above.

Explained here is two-step paper-gap adjustments to the paper-feeding mechanism in the nipping or releasing status. The paper-gap adjustments may however be available for three steps or more. For example, the paper-gap adjustments may be available for 5 steps such as small paper gap (nipping), large paper gap, paper gap for envelope, paper gap for CD-R and release. The operation and procedure in steps S122 to S126 in the flowchart shown in FIG. 18 are performed for each of the paper-gap adjustments. In detail, it is determined in release detection which of the paper-gap adjustments has been made, and then the PF measurements are performed with the PF-measurement sequence corresponding to the detected paper-gap adjustment and the existence of printing paper in the paper-feeding mechanism.

On completion of the PF measurements, it is determined whether there is printing data already received and the printing data is for use in roll-paper printing (step S127).

If there is printing data already received but it not for use in roll-paper printing, the procedures are brought into a halt with no printing process due to mismatching between the printing paper and the received data. The mismatching may be indicated by the lamp on the printer or displayed on the computer monitor-screen connected to the printer.

On the contrary, if there is no printing data already received or there is printing data already received and it is for use in roll-paper printing, a roll-paper mode is set on for execution of roll-paper printing (step S128) and the procedures are brought into a halt. The roll-paper printing is executed thereafter if needed.

Disclosed so far are the operations and procedures of the printer-control apparatus and method according to the present invention in roll-paper replacements. Any types of operations and procedures can be applied, if directly related to roll-paper replacements. In other words, release and PE detection are performed and then the PF measurements are performed in accordance with the results of the detection in the printer-control apparatus and method according to the present invention for roll-paper replacements.

Moreover, disclosed so far are the embodiments for the PF measurements at the time of ink-cartridge and roll-paper replacements in addition to at the time of printer power-on. The PF measurements may further be performed under several requirements, for example, for each completion of printing a specific number of printing papers of a specific paper standards other than roll paper, for each of paper feeding for a specific amount regardless of paper types, or in accordance with temperature variation.

As disclosed, the printer-control apparatus and method according to the present invention, achieve the PF measurements at the time of printer power-on and also other several occasions. The printer-control apparatus and method according to the present invention, also achieve measurements, calculation and updating of average motor currents in accordance with the motor load at a constant-speed driving. These feature offer a precise control of a paper-feed motor for driving a paper-feeding mechanism even at a small paper-feeding amount in each paper-feeding action for printers to be used in several environments, for example, use for 24 hours or a long period of time.

Figure 19:
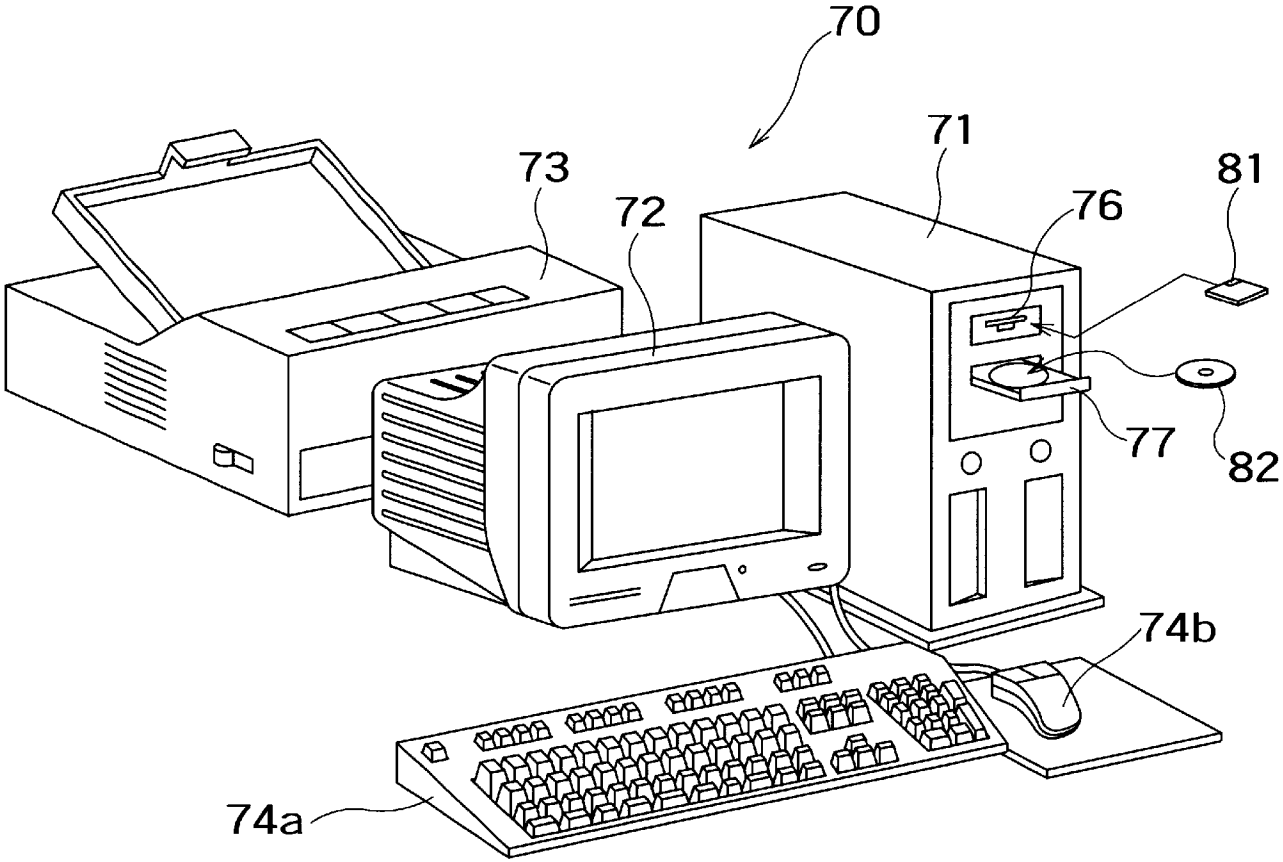
FIG. 19 is an illustration of storage media each storing a program for executing any of the printer-control methods of the present invention, and a computer system that runs the program stored on each storage medium.
Figure 20:
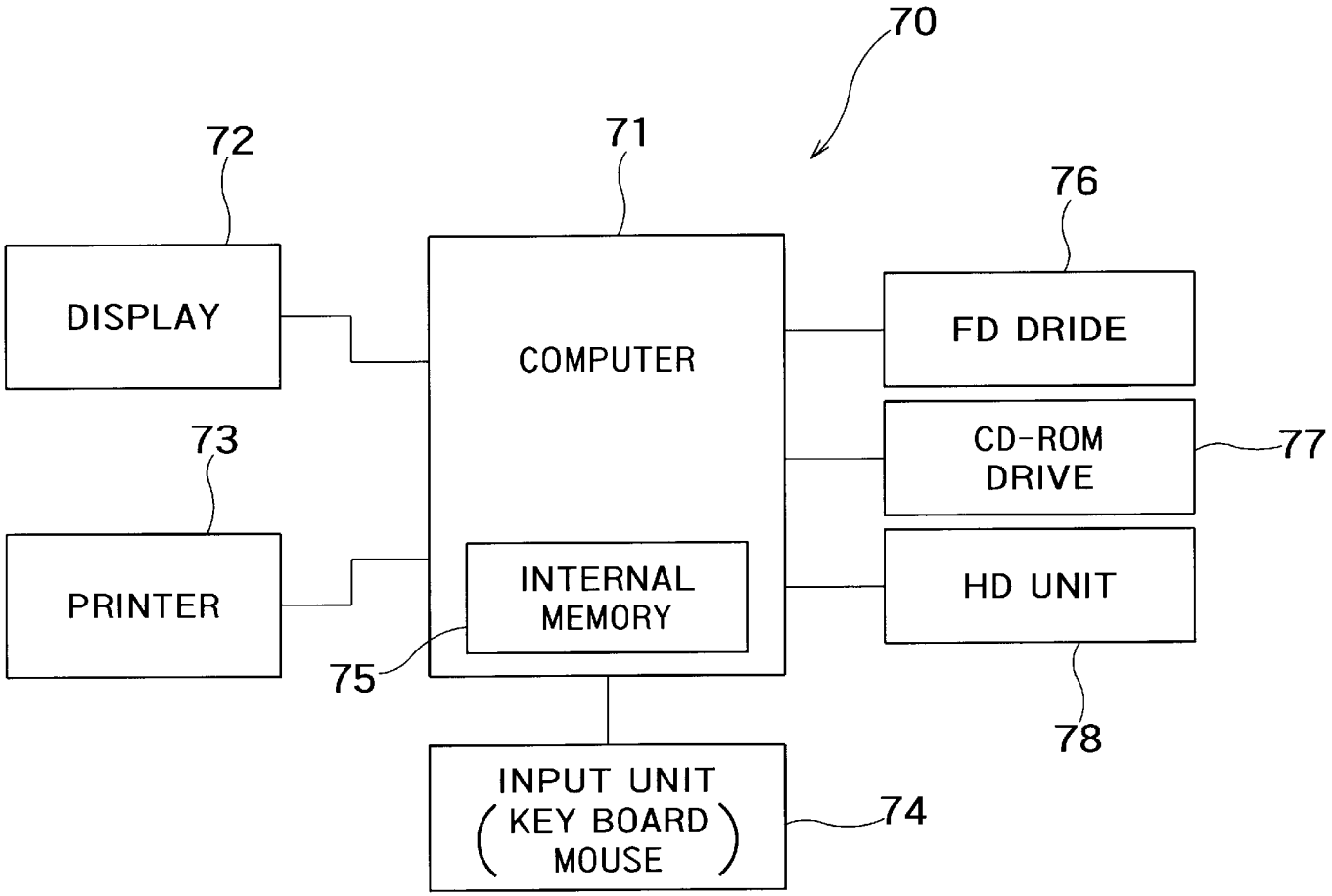
FIG. 20 is a block diagram of the computer system illustrated in FIG. 19.

FIG. 19 is an illustration of storage media each storing a program for executing a printer-control method of the present invention, and a computer system that runs the program stored on each storage medium. FIG. 20 is a block diagram of the computer system illustrated in FIG. 19.

A computer system 70 shown in FIG. 19 is equipped with the following components: a computer 71 installed in a mini-tower frame; a display unit 72, such as a CRT (cathode Ray Tube), a Plasma display and liquid-crystal display; a printer 73 as a recording/output unit; a key board 74*a* and a mouse 74*b* as an input unit; a flexible-disk drive 76; and a CD-ROM drive 77. Shown in FIG. 20 is a block diagram of the computer system 70. Further incorporated into the frame in which the computer 71 is installed are an internal memory 75 such as a RAM (Random Access Memory) and an external memory such as hard-disk drive unit 78. A storage medium storing a program for executing a printer-control method of the present invention is used for the computer system 70. Representatives of the storage medium are a flexible disk 81 and a CD-ROM (Read Only Memory) 82. Other types of storage media, such as MO (magneto Optical) disk, DVD (Digital Versatile Disk), other types of optical disk, card memory and magnetic tape can also be used as the storage medium storing a program for executing a printer-control method of the present invention.

What is claimed is:

1. A printer-control apparatus comprising a PF-measurement generator/executor for generating and executing an operation for PF-measurements to measure a motor current in accordance with load on paper feeding while a paper-feed motor is running at a constant-speed driving in accordance with detection of specific statuses in addition to printer power-on.

2. The printer-control apparatus according to claim 1, wherein the PF-measurements include calculation of an average motor-current value for the paper-feed motor.

3. The printer-control apparatus according to claim 1, wherein the detection of statuses includes detection of ink-cartridge replacements.

4. The printer-control apparatus according to claim 1, wherein the detection of statues includes detection of the replacements of a rolled printing paper.

5. A printer-control apparatus comprising:

an ink-cartridge replacement detector to detect replacements of an ink-cartridge;

a release detector, responsive to the detection of the ink-cartridge replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of the ink-cartridge replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping status, and the determination that no printing paper has been set in the paper-feeding mechanism; and a memory to store accumulated integral values of the motor current calculated through the PF measurements and the average motor current also calculated through the PF measurements for updating.

6. A printer-control apparatus comprising:

a roll-paper replacement detector to detect replacements of a rolled printing paper;

a release detector, responsive to the detection of the roll-paper replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of the roll-paper replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination that no printing paper has been set in the paper-feeding mechanism; and a memory to store accumulated integral values of the motor current calculated through the PF measurements and the average motor current also calculated through the PF measurements for updating.

7. A printer-control apparatus comprising:

a power-on detector to detect printer power-on;

an ink-cartridge replacement detector to detect replacements of an ink-cartridge;

a roll-paper replacement detector to detect replacements of a roll printing paper;

a release detector, responsive to the detection of power on, ink-cartridge replacement or roll-paper replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of power on, ink-cartridge replacement or roll-paper replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of printer power on, ink-cartridge replacement or roll-paper replacements, and the detection of the nipping status and the determination that no printing paper has been set in the paper-feeding mechanism; and a memory to store accumulated integral values of the motor current calculated through the PF measurements and the average motor current also calculated through the PF measurements for updating.

8. A printer-control apparatus comprising:

an ink-cartridge replacement detector to detect replacements of an ink-cartridge;

a release detector, responsive to the detection of the ink-cartridge replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of the ink-cartridge replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping status, and the determination as to whether any printing paper has been set in the paper-feeding mechanism; and a memory to store accumulated integral values of the motor current calculated through the PF measurements and the average motor current also calculated through the PF measurements for updating.

9. A printer-control apparatus comprising:

a roll-paper replacement detector to detect replacements of a roll printing paper;

a release detector, responsive to the detection of the roll-paper replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of the roll-paper replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination as to whether any printing paper has been set in the paper-feeding mechanism; and a memory to store accumulated integral values of the motor current calculated through the PF measurements and the average motor current also calculated through the PF measurements for updating.

10. A printer-control apparatus comprising:

a power-on detector to detect printer power-on;

an ink-cartridge replacement detector to detect replacements of an ink-cartridge;

a roll-paper replacement detector to detect replacements of a roll printing paper;

a release detector, responsive to the detection of power on, ink-cartridge replacement or roll-paper replacements, to determine whether a paper-feeding mechanism is in a nipping status for paper-feeding for printing papers with thickness within a specific range or in a release status for paper-feeding for printing papers with thickness out of the specific range;

a printing-paper detector, responsive to the detection of power on, ink-cartridge replacement or roll-paper replacements, to determine whether any printing paper has been set in the paper-feeding mechanism;

a PF-measurement generator/executor for generating and executing an operation for PF-measurements to measure a motor current in accordance with load on paper feeding while a paper-feed motor is running at a constant-speed driving and calculate an average motor current in accordance with the detection of power on, ink-cartridge replacement or roll-paper replacements, and the detection of the nipping status and the determination as to whether any printing paper has been set in the paper-feeding mechanism; and a memory to store accumulated integral values of the motor current calculated through the PF measurements and the average motor current also calculated through the PF measurements for updating.

11. A printer-control method comprising the step of generating and executing an operation for PF-measurements to measure a motor current in accordance with load on paper feeding while a paper-feed motor is running at a constant-speed driving in accordance with detection of specific statuses in addition to printer power-on.

12. The printer-control method according to claim 11, wherein the PF-measurements include calculation of an average motor-current value for the paper-feed motor.

13. The printer-control method according to claim 11, wherein the detection of statuses includes detection of ink-cartridge replacements.

14. The printer-control method according to claim 11, wherein the detection of statuses includes detection of the replacements of a rolled printing paper.

15. A printer-control method comprising the steps of:

detecting replacements of an ink-cartridge;

in response to the detection of the ink-cartridge replacements, determining whether a paper-feeding mechanism is in a nipping status for paper-feeding for printing papers with thickness within a specific range or in a release status for paper-feeding for printing papers with thickness out of the specific range;

in response to the detection of the ink-cartridge replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping status, and the determination that no printing paper has been set in the paper-feeding mechanism; and storing the average motor current calculated through the PF measurements for updating.

16. A printer-control method comprising the steps of:

detecting replacements of a roll printing paper;

in response to the detection of the roll-paper replacements, determining whether a paper-feeding mechanism is in a nipping status for paper-feeding for printing papers with thickness within a specific range or in a release status for paper-feeding for printing papers with thickness out of the specific range;

in response to the detection of the roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination that no printing paper has been set in the paper-feeding mechanism; and storing the average motor current calculated through the PF measurements for updating.

17. A printer-control method comprising the steps of:

detecting printer power-on, replacements of an ink-cartridge or replacements of a roll printing paper;

in response to the detection of printer power-on, ink-cartridge replacement or roll-paper replacements, determining whether a paper-feeding mechanism is in a nipping status for paper-feeding for printing papers with thickness within a specific range or in a release status for paper-feeding for printing papers with thickness out of the specific range;

in response to the detection of printer power-on, ink-cartridge replacement or roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of printer power-on, ink-cartridge replacement or roll-paper replacements, and the detection of the nipping status and the determination that no printing paper has been set in the paper-feeding mechanism; and storing the average motor current calculated through the PF measurements for updating.

18. A printer-control method comprising the steps of:

detecting replacements of an ink-cartridge;

in response to the detection of the ink-cartridge replacements, determining whether a paper-feeding mechanism is in a nipping status for paper-feeding for printing papers with thickness within a specific range or in a release status for paper-feeding for printing papers with thickness out of the specific range;

in response to the detection of the ink-cartridge replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the ink-cartridge replacements, the detection of the nipping stattus, and the determination as to whether any printing paper has been set in the paper-feeding mechanism; and storing the average motor current calculated through the PF measurements for updating.

19. A printer-control method comprising the steps of:

detecting replacements of a roll printing paper;

in response to the detection of the roll-paper replacements, determining whether a paper-feeding mechanism is in a nipping status for paper-feeding for printing papers with thickness within a specific range or in a release status for paper-feeding for printing papers with thickness out of the specific range;

in response to the detection of the roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of the roll-paper replacements, the detection of the nipping status, and the determination as to whether any printing paper has been set in the paper-feeding mechanism; and storing the average motor current calculated through the PF measurements for updating.

20. A printer-control method comprising the steps of:

detecting printer power-on, replacements of an ink-cartridge or replacements of a roll printing paper;

in response to the detection of printer power-on, ink-cartridge replacement or roll-paper replacements, determining whether a paper-feeding mechanism is in a nipping status for paper-feeding for printing papers with thickness within a specific range or in a release status for paper-feeding for printing papers with thickness out of the specific range;

in response to the detection of printer power-on, ink-cartridge replacement or roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of printer power-on, ink-cartridge replacement or roll-paper replacements, and the detection of the nipping status and the determination as to whether any printing paper has been set in the paper-feeding mechanism; and storing the average motor current calculated through the PF measurements for updating.

21. A storage medium storing a computer program running on a computer system, for controlling a printer, the program having instructions for generating and executing an operation for PF-measurements to measure a motor current in accordance with load on paper feeding while a paper-feed motor is running at a constant-speed driving in accordance with detection of specific statuses in addition to printer power-on.

22. The storage medium according to claim 21, wherein the PF-measurements include calculation of an average motor-current value for the paper-feed motor.

23. The storage medium according to claim 21, wherein the detection of statuses includes detection of ink-cartridge replacements.

24. The storage medium according to claim 21, wherein the detection of statuses includes detection of replacements of a roll printing paper.

25. A storage medium storing a computer program running on a computer system, for controlling a printer, the program having instructions for:

detecting printer power-on, replacements of an ink-cartridge or replacements of a roll printing paper;

in response to the detection of printer power-on, ink-cartridge replacement or roll-paper replacements, determining whether a paper-feeding mechanism is in a nipping status for paper-feeding for printing papers with thickness within a specific range or in a release status for paper-feeding for printing papers with thickness out of the specific range;

in response to the detection of printer power-on, ink-cartridge replacement or roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of power on, ink-cartridge replacement or roll-paper replacements, and the detection of the nipping status and the determination that no printing paper has been set in the paper-feeding mechanism; and storing the average motor current calculated through the PF measurements for updating.

26. A storage medium storing a computer program running on a computer system, for controlling a printer, the program having instructions for:

detecting printer power-on, replacements of an ink-cartridge or replacements of a roll printing paper;

in response to the detection of printer power-on, ink-cartridge replacement or roll-paper replacements, determining whether a paper-feeding mechanism is in a nipping status for paper-feeding for printing papers with thickness within a specific range or in a release status for paper-feeding for printing papers with thickness out of the specific range;

in response to the detection of printer power-on, ink-cartridge replacement or roll-paper replacements, determining whether any printing paper has been set in the paper-feeding mechanism;

generating and executing an operation for PF-measurements to measure a motor current in accordance with load on paper feeding while a paper-feed motor is running at a constant-speed driving and calculate an average motor current in accordance with the detection of power on, ink-cartridge replacement or roll-paper replacements, and the detection of the nipping status and the determination as to whether any printing paper has been set in the paper-feeding mechanism; and storing the average motor current calculated through the PF measurements for updating.

* * * * *